US008362701B2

(12) United States Patent
Yao et al.

(10) Patent No.: US 8,362,701 B2
(45) Date of Patent: Jan. 29, 2013

(54) BALLAST WITH END-OF-LIFE PROTECTION FOR ONE OR MORE LAMPS

(75) Inventors: Gang Yao, ShangHai (CN); Bo Zhang, ShangHai (CN); Fanbin Fabio Wang, ShangHai (CN); Xuefei Xie, ShangHai (CN); Ting Zhang, ShangHai (CN); Peng Sun, ShangHai (CN)

(73) Assignee: General Electric Company, Schenectady, NY (US)

( * ) Notice: Subject to any disclaimer, the term of this patent is extended or adjusted under 35 U.S.C. 154(b) by 606 days.

(21) Appl. No.: 12/548,793

(22) Filed: Aug. 27, 2009

(65) Prior Publication Data

US 2010/0327763 A1 Dec. 30, 2010

(30) Foreign Application Priority Data

Jun. 30, 2009 (CN) ..... 2009 1 0163918

(51) Int. Cl.
*H05B 41/36* (2006.01)

(52) U.S. Cl. ..... 315/158; 315/224; 315/247; 315/291; 315/307

(58) Field of Classification Search ..... 315/282, 315/274, 291, 312, 209 R, 224–225, 307, 315/219, 318, 324, 308
See application file for complete search history.

(56) References Cited

U.S. PATENT DOCUMENTS

| | | | | |
|---|---|---|---|---|
| 5,475,284 | A | 12/1995 | Lester et al. | |
| 5,574,335 | A | 11/1996 | Sun | |
| 5,606,224 | A | 2/1997 | Hua | |
| 5,635,799 | A | 6/1997 | Hesterman | |
| 5,739,645 | A | 4/1998 | Xia et al. | |
| 5,777,439 | A | 7/1998 | Hua | |
| 5,808,422 | A | 9/1998 | Venkitasubrahmanian et al. | |
| 5,859,509 | A | 1/1999 | Bienz et al. | |
| 5,930,126 | A | 7/1999 | Griffin et al. | |
| 6,127,867 | A | 10/2000 | Coughlin, Jr. et al. | |
| 6,232,727 | B1 | 5/2001 | Chee et al. | |
| 6,281,641 | B1 | 8/2001 | Chen et al. | |
| 6,294,879 | B1 | 9/2001 | Nagase et al. | |
| 6,337,544 | B1 | 1/2002 | Wang et al. | |
| 6,661,182 | B2 | 12/2003 | Sridharan | |
| 6,741,043 | B2 | 5/2004 | Prasad | |
| 6,828,732 | B2 | 12/2004 | Yang et al. | |
| 6,919,695 | B2 | 7/2005 | Van Casteren | |
| 6,919,696 | B2 | 7/2005 | Van Casteren | |
| 7,102,297 | B2 * | 9/2006 | Trestman et al. | 315/282 |
| 7,239,094 | B2 | 7/2007 | Radzinski et al. | |
| 7,247,998 | B2 | 7/2007 | Poehlman et al. | |
| 2006/0279232 | A1 * | 12/2006 | Takahama et al. | 315/282 |
| 2007/0241693 | A1 | 10/2007 | Chan et al. | |

* cited by examiner

*Primary Examiner* — Shawki Ismail
*Assistant Examiner* — Christopher Lo
(74) *Attorney, Agent, or Firm* — Fay Sharpe LLP

(57) ABSTRACT

Ballasts are presented with improved end-of-life (EOL) detection of lamp DC voltage components and protection circuits to facilitate user maintenance and extend lamp life using selective dimming with preheating when EOL conditions are detected.

23 Claims, 18 Drawing Sheets

BALLAST WITH END-OF-LIFE PROTECTION FOR ONE OR MORE LAMPS

CROSS-REFERENCE TO RELATED APPLICATIONS

This application claims priority to and the benefit of Chinese patent application No. 200910163918.7, filed Jun. 30, 2009, the entirety of which is hereby incorporated by reference.

BACKGROUND OF THE DISCLOSURE

Ballasts are used in the artificial illumination arts for controlling power applied to lamps, such as fluorescent lamps. When such lamps are in use for extended lengths of time, thermionic emission materials coated on the lamp electrode, such as Barium, Strontium, etc. tend to be absorbed by the lamp tube walls, leaving the electrode coating depleted. When this electrode coating reaches a certain level, the voltage and current of the lamp become asymmetrical and once the coated material is completely depleted, the lamp can no longer be turned on. Partial depletion of the thermionic emission material, moreover, leads to increased electrode heating due to increased electrode resistance and a constant electrode current. In order to mitigate or avoid excess electrode heat, it is desirable to identify and replace lamps that are nearing the end of their service life prior to complete depletion of the electrode coating. However, a user typically cannot visually distinguish an end-of-life lamp from a good lamp. A need therefore exists for ballasts which facilitate the identification of end-of-life lamps.

SUMMARY OF THE DISCLOSURE

Electronic ballasts are presented by which end-of-life lamps may be identified while mitigating or avoiding the thermal issues associated with operating lamps with fully depleted electrode coating materials. In one embodiment, an electronic ballast is provided which includes an inverter and an end-of-life (EOL) detection circuit that senses absolute DC lamp voltages and generates an end-of-life signal based on a maximum one of the absolute DC lamp voltages. One embodiment of the EOL detection circuit includes a plurality of absolute DC lamp voltage sensing circuits, each having a resistor coupled between a corresponding line of the inverter output and an intermediate node, and a capacitance coupled between the intermediate node and a sensing node, as well as a maximum lamp DC voltage circuit that determines the maximum absolute DC lamp voltage and generates the EOL signal. The maximum lamp DC voltage circuit in one embodiment is comprised of a plurality of first diodes coupled between corresponding intermediate nodes and the maximum lamp DC voltage output, a plurality of second diodes coupled between the corresponding intermediate nodes and a circuit ground, a positive sensing capacitance and a positive sense resistor coupled in parallel between the maximum lamp DC voltage output and the sense node, a negative sensing capacitance and a negative sense resistor coupled in parallel between the sense node and the circuit ground, and a comparator that compares the EOL signal with a threshold and generates a comparator output signal to indicate whether an EOL condition has been detected in the ballast.

In another embodiment, an electronic ballast is provided, having an inverter to drive a plurality of lamps, and an EOL detection circuit that senses DC lamp voltages and generates an EOL signal at a lamp DC voltage output coupled with common cathodes of the lamps. The EOL detection circuit includes a plurality of absolute DC lamp voltage sensing circuits individually comprised of a resistor and a capacitance coupled in parallel between a corresponding line of the inverter output and a corresponding lamp, as well as a sense capacitance coupled between the lamp DC voltage output and a circuit ground. The EOL detection circuit also includes a comparator that compares the EOL signal with a threshold and generates a comparator output signal to indicate whether an EOL condition has been detected in the ballast.

A further embodiment includes an EOL detection and protection circuit with a comparator providing an output signal when an EOL condition has been detected and a logic circuit that sets the lamp current to a first dimming value below the normal lamp operating level for a first predetermined time period in order to cause EOL lamps to go out, and then sets the lamp current to a second somewhat higher dimming value for a second predetermined time period to avoid excessively low lamp current to non-EOL lamps without igniting the EOL lamps. The circuit may then repeat the first and second dimming levels if the detected EOL condition persists, and return to the normal operating current if the EOL signal is removed, such as when a user replaces the EOL lamp(s). This allows a user to indentify which lamp or lamps are in the EOL condition as these will be out, while keeping the other lamps operating at a dimmed level. In a related embodiment, the inverter controls the frequency of the inverter dimming lamp current to be above 100 Hz so that users will not sense lamp flashing.

A further electronic ballast embodiment includes a logic circuit to dim the lamp current and to activate a preheating circuit when an EOL condition has been detected, so as to prevent degradation of non-EOL lamps operating at the dimming current level.

In other embodiments, an electronic ballast is provided with a current-fed inverter and an EOL detection circuit, where the secondary side of the inverter transformer has an output circuit ground coupled with a stable node of the DC power source so that EOL detection and protection circuitry can control the inverter operation for EOL conditions without requiring isolated feedback components. In certain examples, the output circuit ground is directly or capacitvely coupled with a negative circuit branch or a positive circuit branch of the DC power source between the input power and a series inductance of the DC source.

Another embodiment provides an electronic ballast with an EOL detection and protection circuit including a comparator generating an output signal when an EOL condition has been detected and a latch circuit providing a latched comparator output signal until a reset signal is received. The ballast further includes a relamping circuit coupled with a common cathode connection of the inverter output to sense a common cathode resistance of the lamps and which selectively provides the latch reset signal when a change in the sensed common cathode resistance of the plurality of lamps indicates one or more of the lamps has been replaced. In one implementation, the relamping circuit comprises a series combination of an inductance and a relamping capacitance connected in parallel across the common cathode resistance of the plurality of lamps, and a transistor with a control terminal coupled to a center node of the inductance and the relamping capacitance, where the transistor has a signal terminal provide the reset signal to the latch circuit when a change in the sensed common cathode resistance of the plurality of lamps indicates at least one of the lamps has been replaced.

In other embodiments, the ballast EOL detection circuit includes a transformer with a secondary circuit and at least one primary winding, where the secondary side has a rectifier circuit operatively providing a DC detection signal based on the secondary current, and a logic circuit to provide the inverter control input to dim the lamp current when the DC detection signal exceeds a threshold. The EOL detection circuit also includes a diac coupled in series with the primary winding and a capacitance coupled in parallel across the series combination of the diac and the primary winding of the transformer. Certain implementations include a plurality of sense resistors having first terminals coupled with the capacitance and the primary winding of the transformer, and second terminals coupled with corresponding lines of the inverter output, where the diac and the capacitance may be connected together at a node coupled with a common cathode terminal of the inverter output or at a node coupled with a lamp output terminal of the inverter output. In another implementation, the EOL detection circuit is comprised of multiple sense circuits individually coupled with a corresponding lamp, with the individual sense circuits including a primary winding of the transformer, a diac coupled in series with the primary winding, as well as a capacitance coupled in parallel across the series combination of the diac and the primary winding, and a sense resistor coupled in series with the capacitance between the corresponding lamp output terminal of the inverter output and the corresponding lamp. In yet another implementation, the end-of-life detection circuit includes a primary side rectifier coupled with the inverter output and operative to rectify lamp voltages of the plurality of lamps, the primary side rectifier having a positive circuit branch and a negative circuit branch, as well as a first rectifier sense resistor coupled to the positive circuit branch of the primary side rectifier, and a second rectifier sense resistor coupled between the first rectifier sense resistor and the negative circuit branch of the primary side rectifier, with a center node connecting the first and second rectifier sense resistors is coupled to the capacitance and to the primary winding of the transformer.

BRIEF DESCRIPTION OF THE DRAWINGS

One or more exemplary embodiments are set forth in the following detailed description and the drawings, in which.

DETAILED DESCRIPTION OF THE PREFERRED EMBODIMENTS

Figure 1:
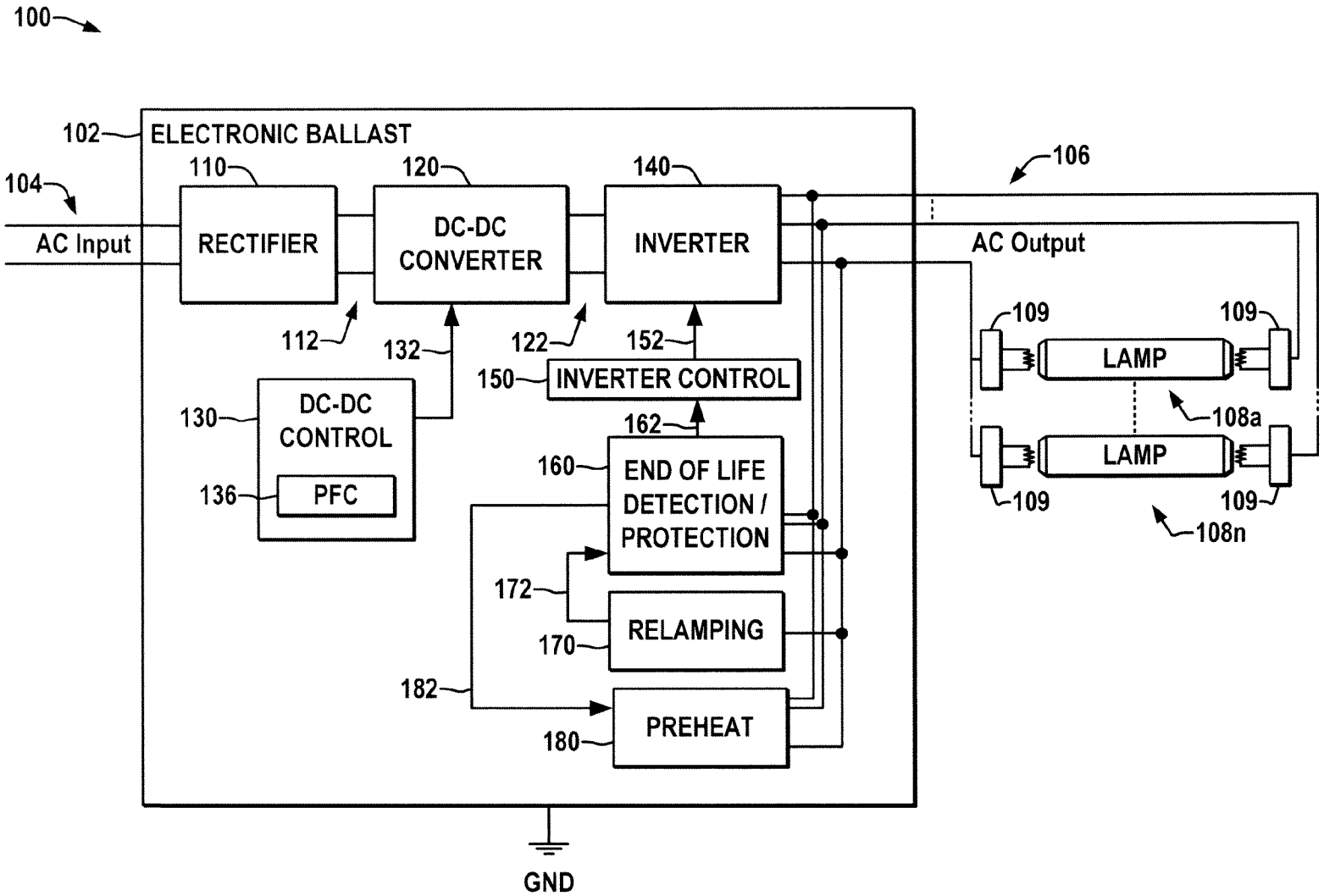
FIG. 1 illustrates an exemplary electronic ballast with an end-of-life (EOL) detection and protection circuit.

Referring now to the drawings, where like reference numerals are used to refer to like elements throughout, and wherein the various features are not necessarily drawn to scale, FIGS. 1-4 illustrate an exemplary electronic ballast 102 with an output 106 for providing AC output power to operate one or more lamps 108. As shown in the embodiment of FIG. 1, the ballast 102 includes a rectifier 110 that receives and rectifies single or multi-phase AC power from a ballast input 104, where any form of active or passive, full or half-wave rectifier 110 may be employed, such as a full bridge rectifier having four diodes (not shown) in one embodiment. The rectifier 110 has an output 112 providing a rectified DC voltage to a switching type DC-DC converter 120 in one embodiment, which includes various switching devices operated by control signals 132 from a controller 130 to convert the rectified DC voltage into a converter DC output voltage at a converter output 122.

The DC-DC converter controller 130 can be any suitable hardware, software. firmware, configurable/programmable logic, or combinations thereof by which suitable switching control signals 132 may be generated for driving the switching devices of the DC-DC converter 120 to implement a desired conversion of the rectified DC to a converter DC output. The converter control 130 in some embodiments includes a power factor control component 136 to control the power factor of the ballast 102. In other embodiments, a passive DC-DC converter 120 may be used, and the converter 120 (active or passive) may include various capacitances such as for voltage-fed inverter applications and/or link chokes or inductances for current-fed inverter embodiments (e.g., link inductances L1 and L2 in the examples of FIGS. 2 and 10-12).

The ballast 102 includes an inverter 140 which operates to convert the DC output voltage and current 122 to provide an AC output to drive one or more lamps 108 at an inverter output 106. The inverter 140 may be any suitable DC to AC converter, such as including switching devices operated according to inverter control signals 152 from an inverter controller 150, and which may optionally include a transformer or other isolation components (not shown) to isolate the AC output from the input power.

Figure 2:
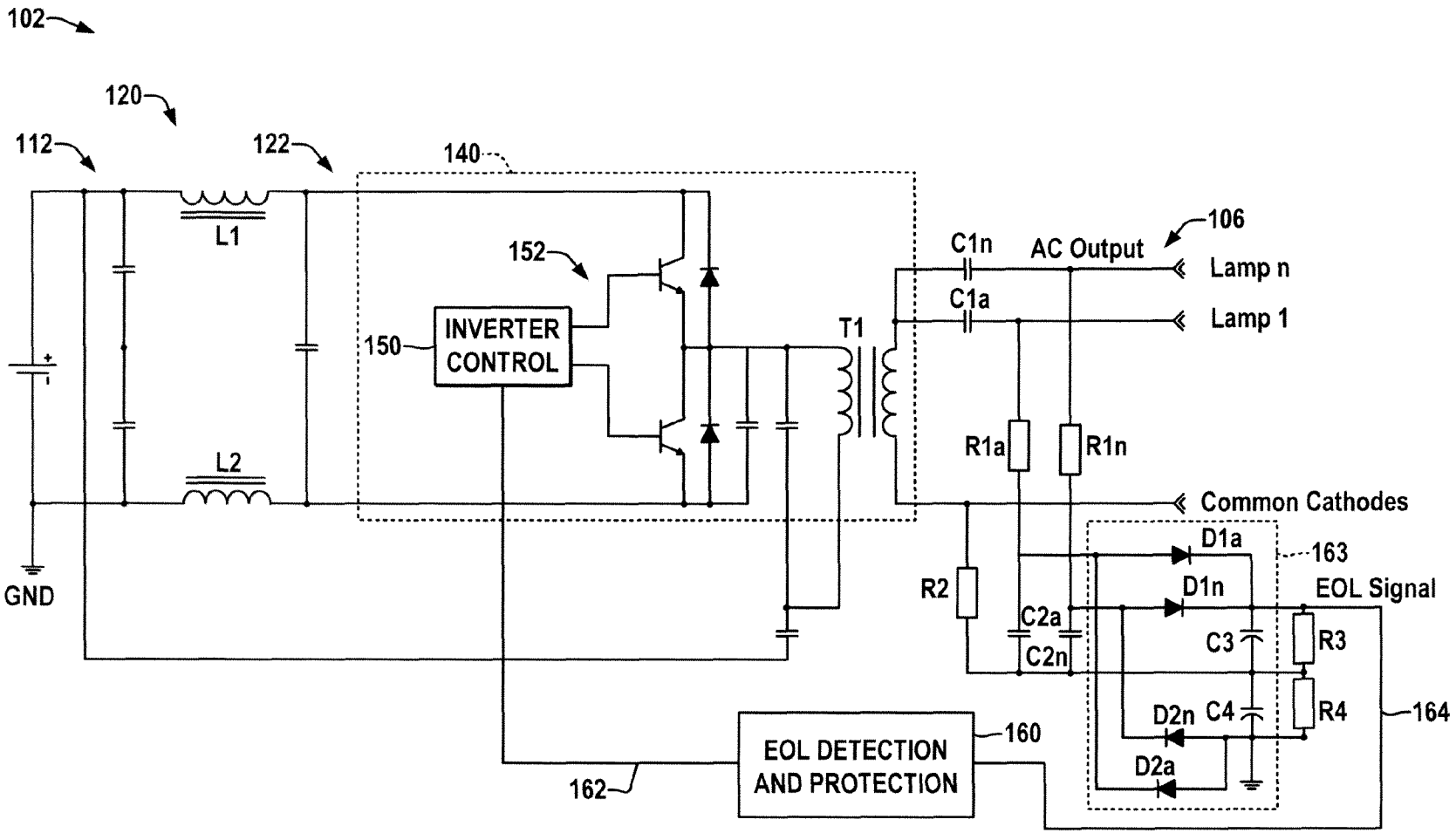
FIG. 2 illustrates further details of a current-fed inverter and EOL detection circuitry in the ballast of FIG. 1.

FIG. 2 illustrates an exemplary current-fed implementation of a two device inverter 140 with inductances L1 and L2 in the DC power source 120 with an input 112 receiving input power, an output 122 providing DC electrical power to the inverter 140, and positive and negative (e.g., upper and lower) circuit branches coupled between the input 112 and the output 122 including the series inductances L1 and L2, respectively, coupled between the input 112 and the output 122.

As shown in FIGS. 1 and 2, the ballast 102 is operative to drive an integer number "n" lamps 108 via the inverter 140, where the inverter output 106 includes n positive lines for coupling to first ends of the driven lamps 108 and a common cathode connection coupled to the second lamp ends. As best shown in FIG. 1, the ballast 102 also includes an end-of-life EOL detection protection circuit 160 operatively coupled with the inverter output 106 to sense absolute or other DC lamp voltages of the individual lamps 108 and which provides an inverter control input 162 to control the AC output voltage at the inverter output 106 in certain modes of operation. An inverter controller 150 provides an inverter control signal 152 to the inverter 140 based at least in part on an inverter control input 162 from the EOL circuit 160 to control the AC output voltage at the inverter output 106.

The ballast 102 may also include a relamping circuit 170 coupled with the common cathode connection of the inverter output 106 to sense a common cathode resistance of the lamps 108 to detect a user replacing one or more lamps, and which in certain embodiments selectively provides a latch reset signal 172 to the EOL circuit 160 as discussed further below in connection with FIGS. 13 and 14. Certain embodiments of the ballast 102, moreover, may include a preheat circuit 180 coupled with preheat or instant start circuits 109 at the inverter output 106 to selectively provide current to preheat the lamp cathodes according to a preheat control signal 182 from the EOL circuit 160.

Figure 3:
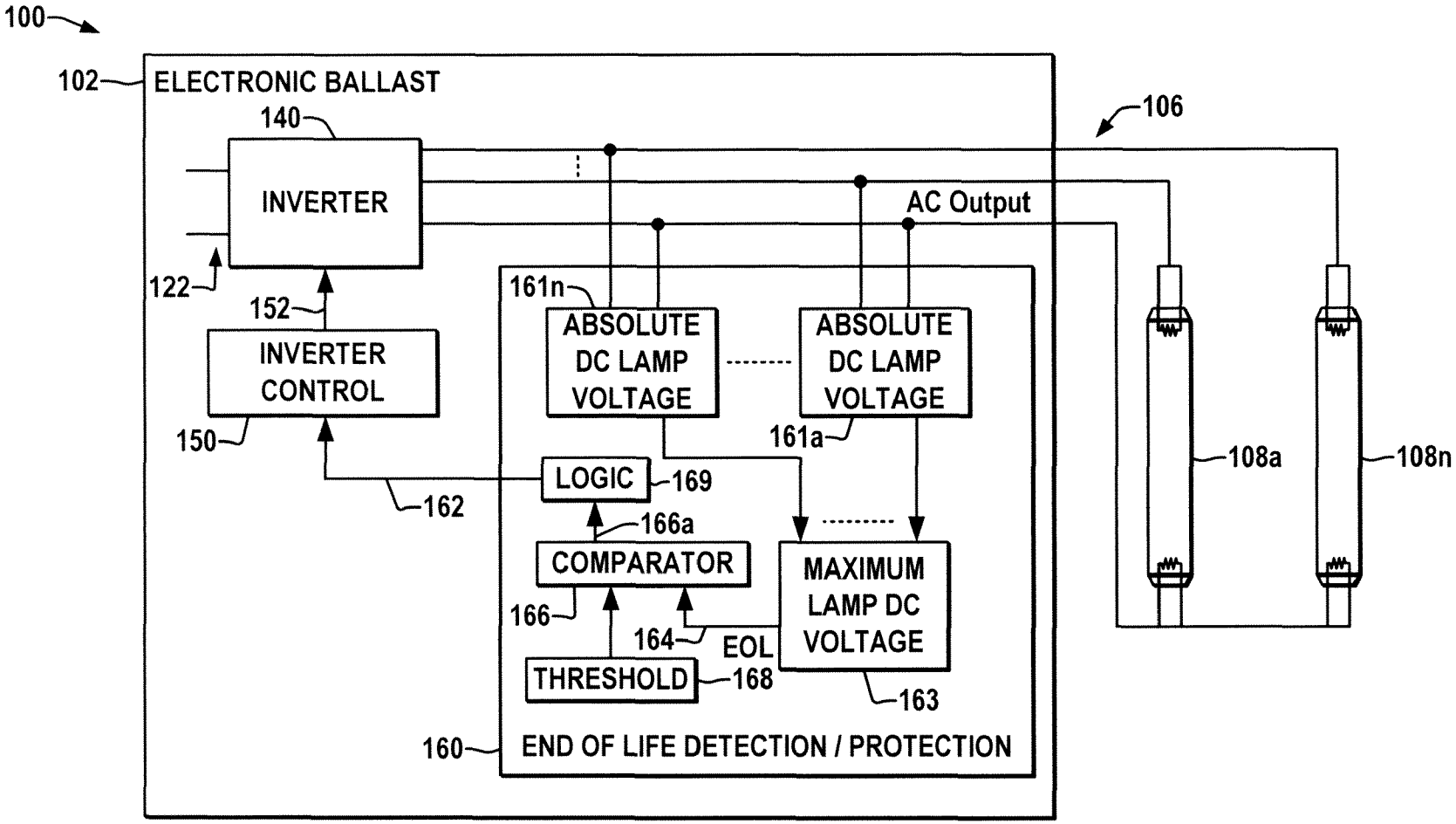
FIGS. 3 and 4 illustrate an electronic ballast embodiment with a EOL detection circuit that senses absolute DC lamp voltages and generates an EOL signal based on the highest absolute DC lamp voltage.
Figure 4:
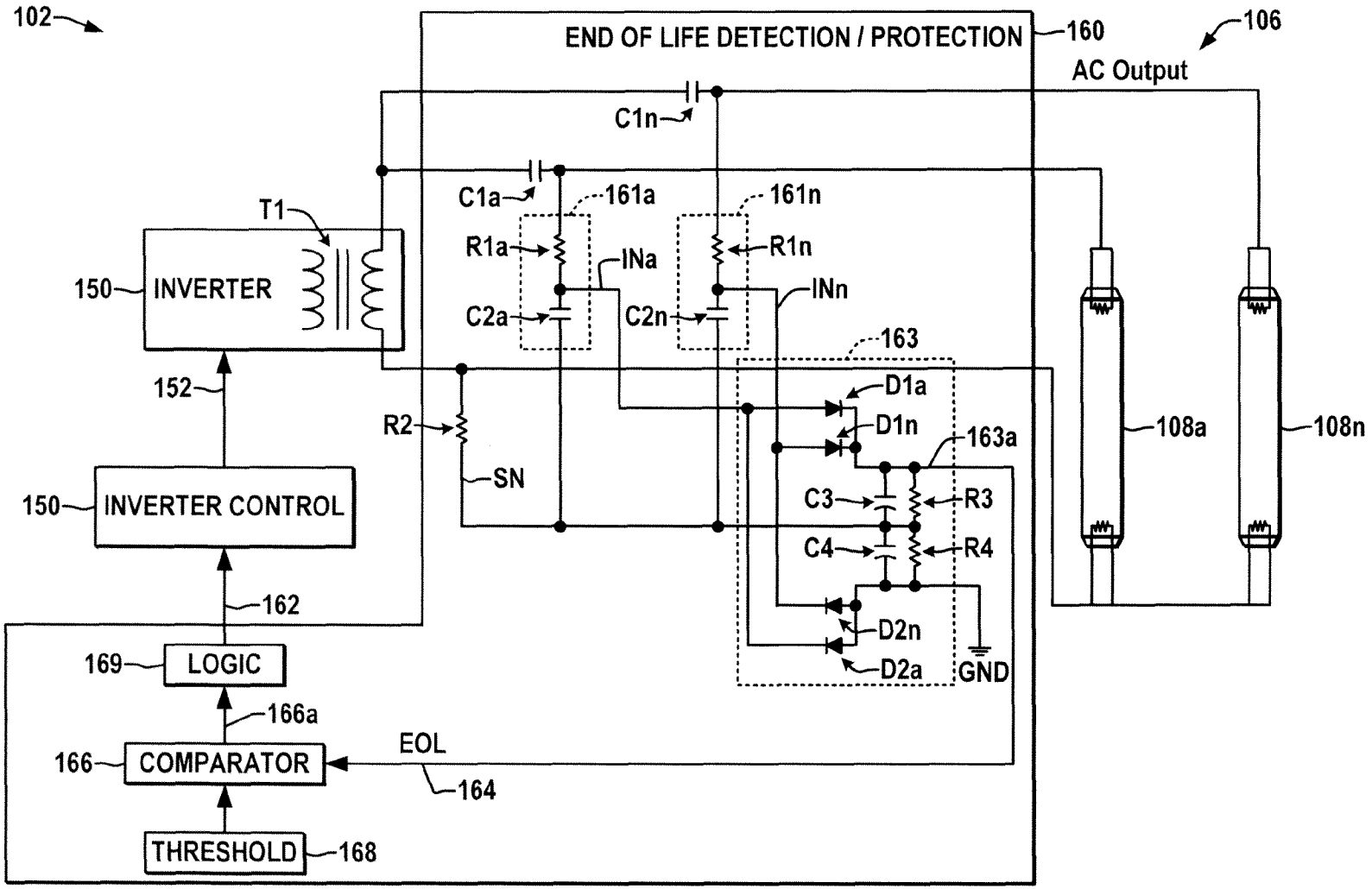

FIGS. 3 and 4 show embodiments of the ballast 120 in which the EOL detection circuit 160 is operative to sense absolute DC lamp voltages of individual lamps 108 and to generate an end-of-life (EOL) signal 164 based on a maximum one of the absolute DC lamp voltages. As shown in FIG. 3, the end-of-life EOL detection circuit 160 includes two or more absolute DC lamp voltage sensing circuits 161 operatively coupled with the inverter output 106 to sense absolute DC lamp voltages of the corresponding lamps 108, as well as a maximum lamp DC voltage circuit 163 coupled with the absolute DC lamp voltage sensing circuits 161. The circuit 163 is operative to determine a maximum one of the absolute DC lamp voltages and to generate the EOL signal 164 at a maximum lamp DC voltage output 163*a* (FIG. 4) based on the maximum absolute DC lamp voltage. The EOL signal in this embodiment is provided as an input to a comparator 166 that compares the EOL signal value to a threshold value 168 to generate a comparator output signal 166*a* having a first state when the EOL signal 164 is less than the threshold 168 and a second state indicating at least one lamp has reached an end-of-life condition when the EOL signal 164 is greater than the threshold 168. The comparator output in certain embodiments is provided (latched or unlatched) to a logic circuit 169 that generates the inverter control input 162 to control the AC output voltage at the inverter output 106 in certain modes of operation.

FIG. 4 shows one example of an EOL circuit 160, in which the individual absolute DC lamp voltage sensing circuits 161 include a resistor R1 coupled between a corresponding line of the inverter output 106 and an intermediate node IN, and a capacitance C2 coupled between the intermediate node and a sensing node SN. In this embodiment, the maximum lamp DC voltage circuit 163 includes a plurality of first diodes D1*a*, D1*n* coupled between the corresponding intermediate nodes IN and the maximum lamp DC voltage output 163*a*, and a corresponding plurality of second diodes D2*a*, D2*n* coupled between the intermediate nodes IN and a circuit ground GND. A positive sensing capacitance C3 and a positive sense resistor R3 are coupled in parallel between the maximum lamp DC voltage output 163*a* and the sense node SN, and a negative sensing capacitance C4 and a negative sense resistor R4 are coupled in parallel between the sense node SN and the circuit ground GND. The comparator 166 in this embodiment compares the EOL signal 164 from the maximum lamp DC voltage output 163*a* with the threshold 168 and to generate the comparator output signal 166*a* having a first state when the end-of-life signal 164 is less than the threshold 168 and a second state indicating at least one lamp has reached an end-of-life condition when the end-of-life signal 164 is greater than the threshold 168.

The embodiments of FIGS. 3 and 4 provide improved EOL detection compared with prior techniques. Conventional EOL detection schemes, particularly for multiple-lamp ballasts 102, may incorrectly indicate EOL conditions when two lamps reach early EOL stage at the same time. Also, prior EOL detection configurations may not trigger the EOL signal in the situation when both lamps reach end-of-life simultaneously. The embodiments of FIGS. 3 and 4 avoid or mitigate these shortcomings by separately sensing the absolute DC voltage of individual lamps via the circuits 161, and then determine the maximum DC voltage value of the circuits 161 via the circuit 163, which is then compared to the threshold. This approach thus ensures proper EOL signal generation for different kinds of lamps and is operable for multi-lamp applications.

Figure 5:
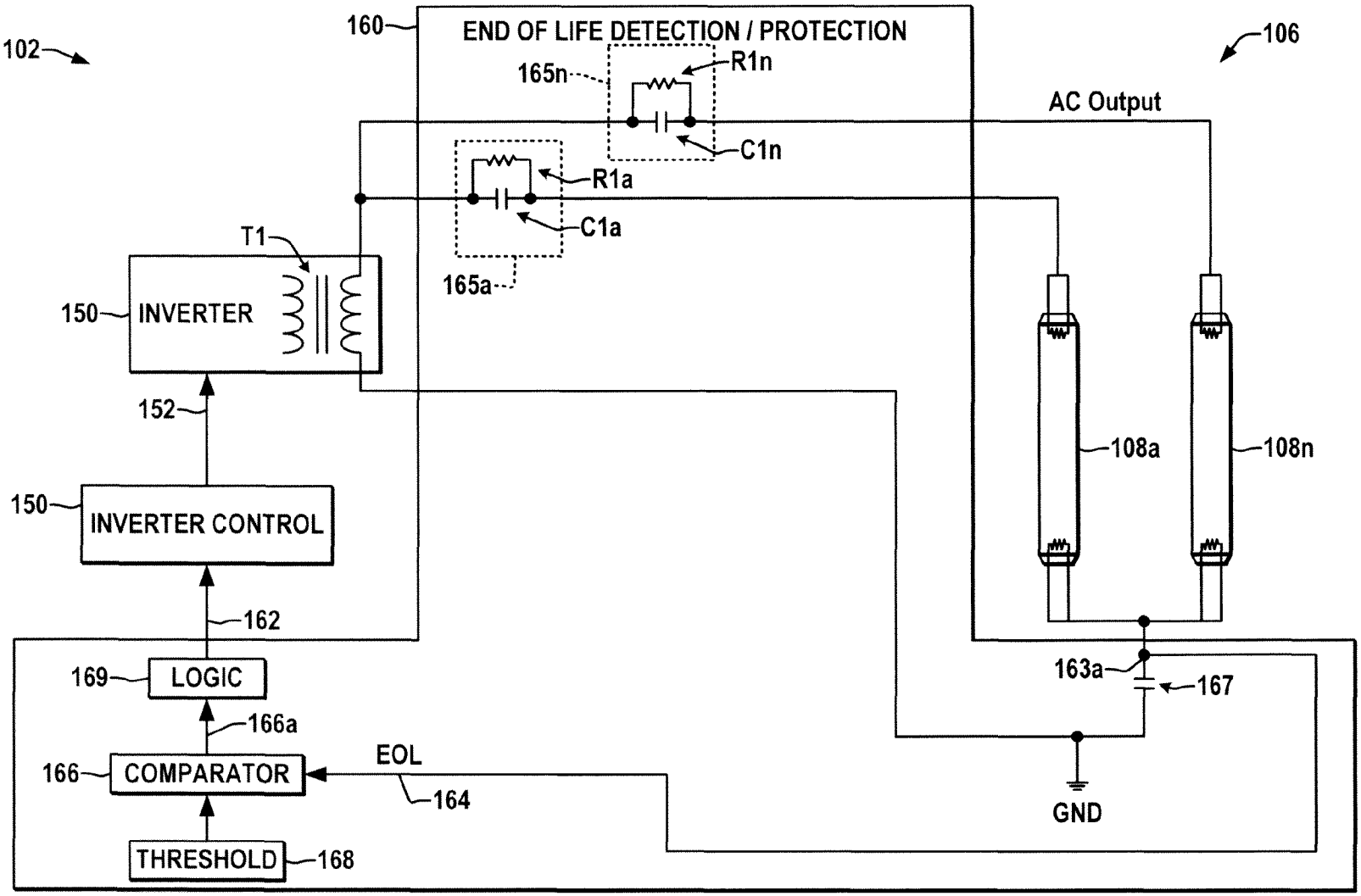
FIG. 5 illustrates another ballast embodiment with parallel resistor and capacitor circuits in each inverter output line for sensing lamp DC voltages for EOL detection.

FIG. 5 illustrates another electronic ballast 102 with a plurality of absolute DC lamp voltage sensing circuits 165 in each inverter output line for sensing lamp DC voltages for EOL detection. In this embodiment, a sense capacitance 167 is coupled between the lamp DC voltage output 163*a* and a circuit ground GND, and the absolute DC lamp voltage sensing circuits 165 individually include a resistor R1*s*, R1*n* and a capacitance C1*a*, C1*n* coupled in parallel between a corresponding line of the inverter output 106 and a corresponding lamp 108. The comparator 166 compares the EOL signal 164 from the lamp DC voltage output 163*a* with the threshold 168 to generate the comparator output signal 166*a*. In this embodiment, the DC components associated with the individual lamps 108 are transferred to the sense capacitance 167 and the DC component value in normal operation is constant regardless of the number of connected lamp loads 108, and operates for series or parallel lamp configurations.

Figure 6:
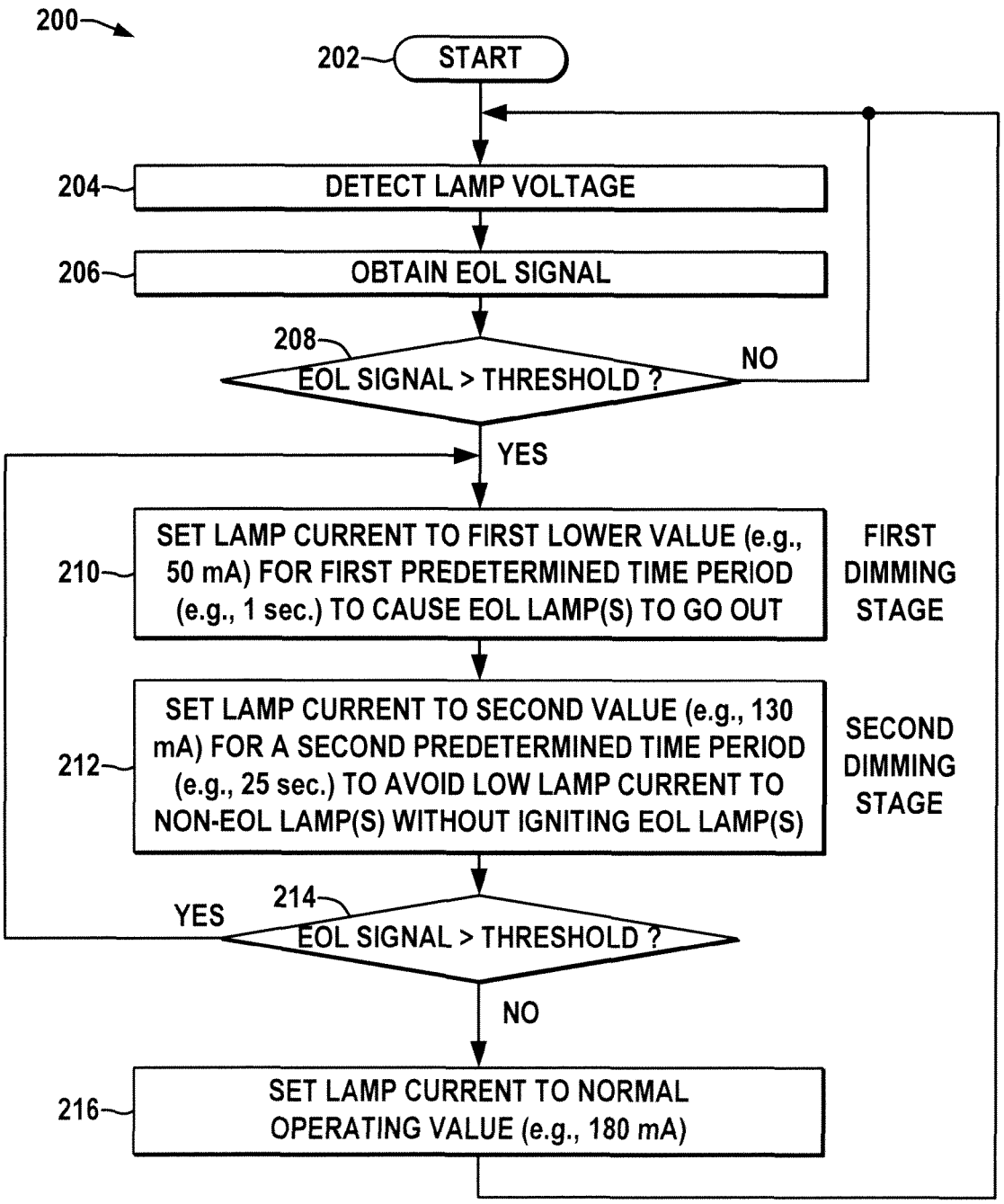
FIGS. 6 and 7 illustrate a flow diagram and signal diagrams showing operation of a logic circuit in the EOL detection and protection circuit for dual level lamp dimming for detected EOL conditions.
Figure 7:
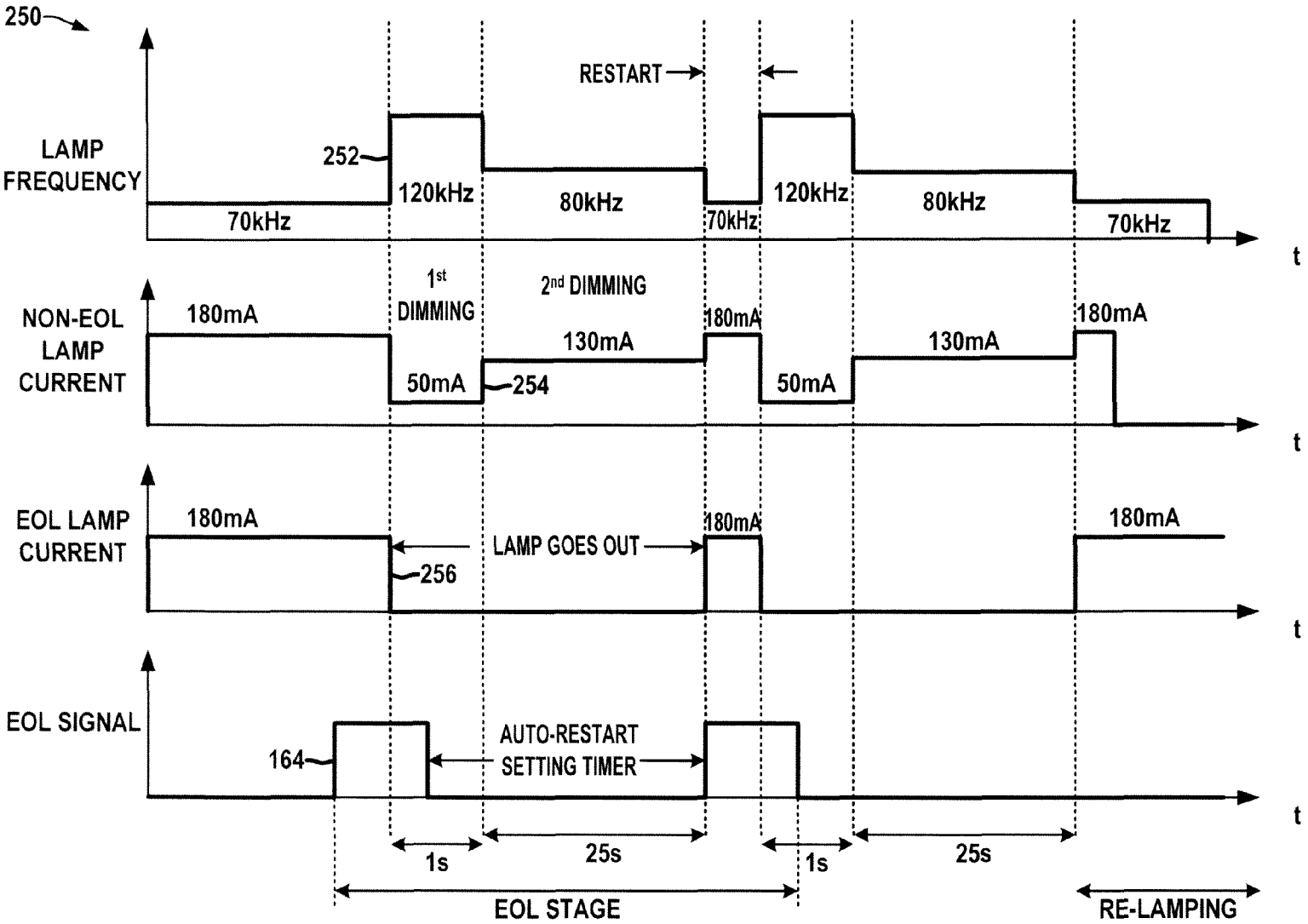

FIGS. 6 and 7 illustrate operation of an exemplary logic circuit 169 in the EOL detection and protection circuits 160 described herein, where the EOL detection and protection circuit 160 provides dual level lamp dimming for detected EOL conditions. FIG. 6 illustrates an exemplary flow diagram 200 and FIG. 7 depicts a signal diagrams showing operation of the exemplary logic 169. Starting at 202 in FIG. 6, the lamp voltages are detected at 204 and the EOL signal is obtained at 206, such as by the above described absolute DC value detection and maximum DC voltage selection techniques or by any other suitable ways of generating an EOL signal. A determination is made at 208 as to whether the EOL signal is greater than a threshold, and if not, the process repeats at 204-208. FIG. 7 illustrates signal curves 252, 254, 256, and 164, respectively showing inverter open-circuit voltage (OCV), non-EOL lamp current. EOL lamp current, and EOL signal for normal, EOL, and re-lamping modes in the ballast 102. When the EOL signal exceeds the threshold (YES at 208 in FIG. 6), the logic 169 advantageously provides for first and second dimming stages of predetermined first and second time period durations as shown in FIG. 7.

At 210 in FIG. 6, the logic circuit 169 provides the inverter control input 162 such that the lamp current provided by the inverter 140 is set to a first dimming value less than the normal lamp current operating value for a first predetermined time period. As shown in FIG. 7, when the EOL signal 164 goes high, the logic 169 thereafter reduces the inverter OCV 252 from a normal value of 400 volts to a first dimming OCV value of about 80 volts, thereby reducing the non-EOL lamp current from a normal value of about 180 mA to a first dimming value of about 50 mA. This first dimming current level is set low enough to cause EOL lamps 108 to go out (e.g., the EOL lamp current 256 in FIG. 7 goes too zero in the first dimming stage). This condition is maintained by the logic 169 for a first predetermined time period, such as about 1 seconds in the illustrated example.

The logic then proceeds after the first time period has passed to a second dimming stage at 212 in FIG. 6, where, the inverter control input 162 is provided so as to set the non-EOL lamp current to a second dimming value (e.g., 130 mA) that is greater than the first dimming value (e.g., 50 mA) and less than the normal lamp current operating value (e.g., 180 mA) for a second predetermined time period (e.g., about 25 seconds in one embodiment). This second dimming stage is set high enough to avoid or mitigate excessively low lamp current to the non-EOL lamps 108 while preventing ignition of the EOL lamps 108.

In the illustrated embodiment, moreover, the logic 169 again verifies the EOL signal level at 214, and if the signal 164 remains high (YES at 214), the logic then repeats the first and second dimming stages. In this manner, the EOL lamp or lamps 108 are turned off allowing easy visual identification by a user that (1) there is a problem and (2) which lamp(s) to change. In certain embodiments, moreover, where the inverter controller 150 provides the inverter control signal 152 to the inverter 140 during the EOL stage such that the frequency of the inverter dimming lamp current is greater than 100 Hz so that users will not sense lamp flashing.

Figure 8:
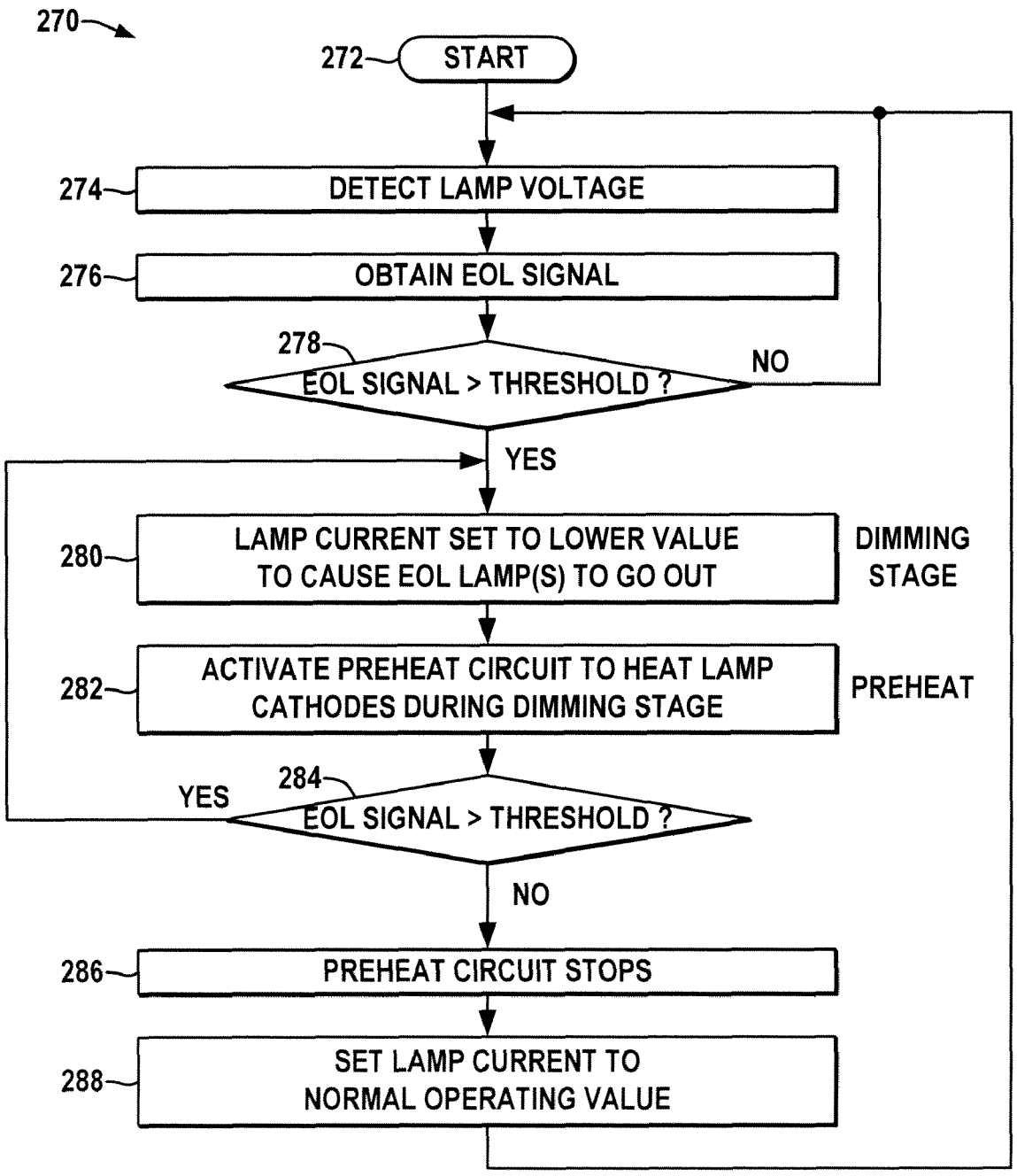
FIGS. 8 and 9 illustrate a flow diagram and signal diagrams showing operation of a logic circuit in the EOL detection and protection circuit for concurrent lamp dimming and preheating for detected EOL conditions.
Figure 9:
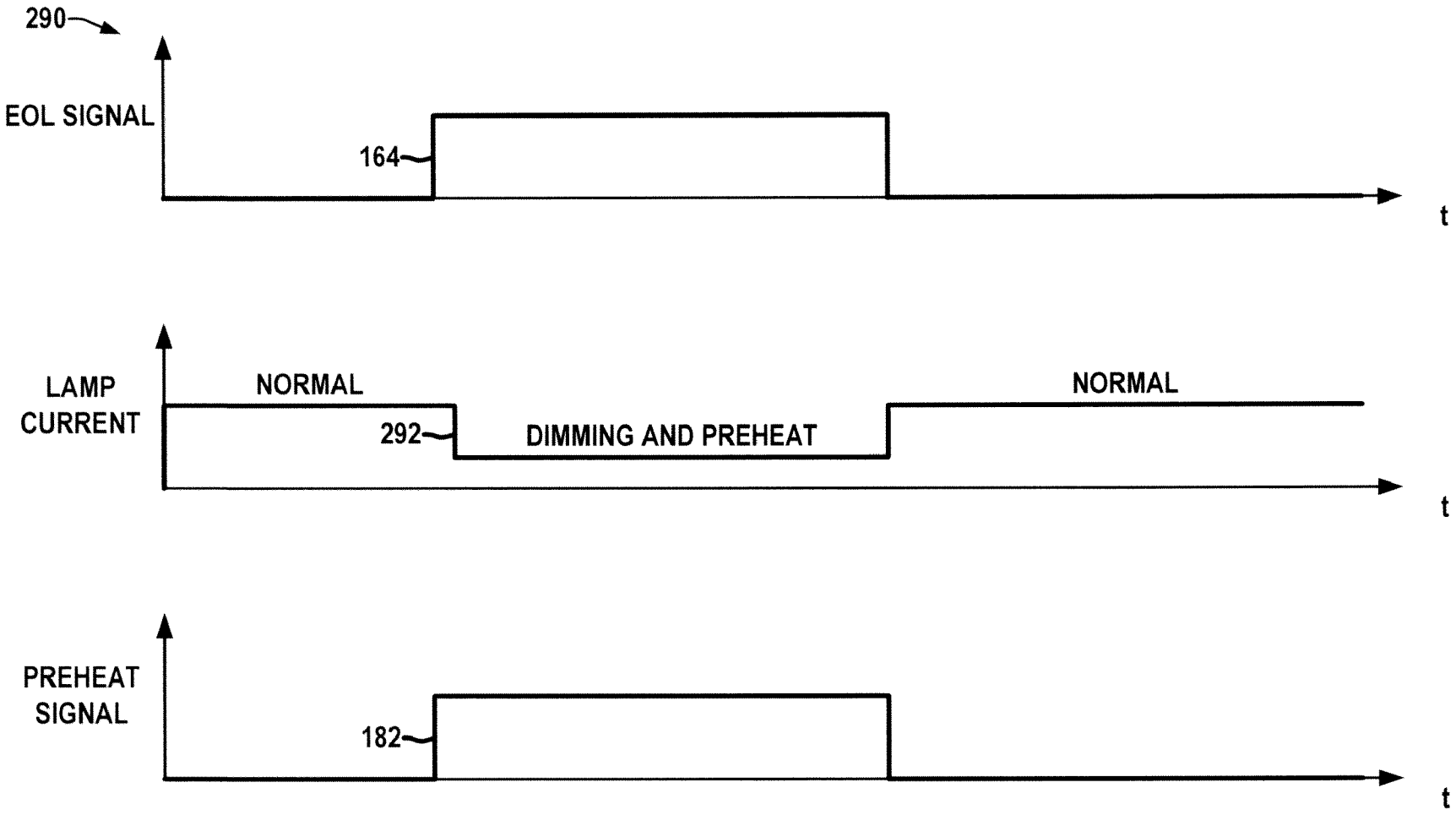

FIGS. 8 and 9 illustrate another embodiment of the operation of the logic circuit 169 in the electronic ballast 102. FIG. 270 illustrates a flow diagram 270 that begins at 272, with the lamp voltage being detected by the EOL circuit 160 at 276 and the EOL signal being obtained at 276. The EOL signal 164 is compared at 278 to the threshold. If the EOL signal is above the threshold (YES at 278), the logic 169 provides the control input 162 at 280 so as to set a lamp current to a dimming value below the normal lamp current operating value and also provides the preheat control signal 182 to activate the preheat circuit 180 (FIG. 1 above) to provide current to preheat the common cathodes of the lamps 108 at 282. As shown in the signal diagram 290 of FIG. 9, the logic 169 activates the preheat signal 182 when the EOL condition is detected and the lamp current 292 is lowered for a dimming and preheat stage until the user replaces the EOL lamp(s) 108. This operation of the logic 169 prevents ballast shut down during lamp EOL conditions thereby facilitating maintenance and provides protective preheating during dimming operation to prolong lamp life, and is thus advantageous particularly for parallel lamp configurations.

Figure 10:
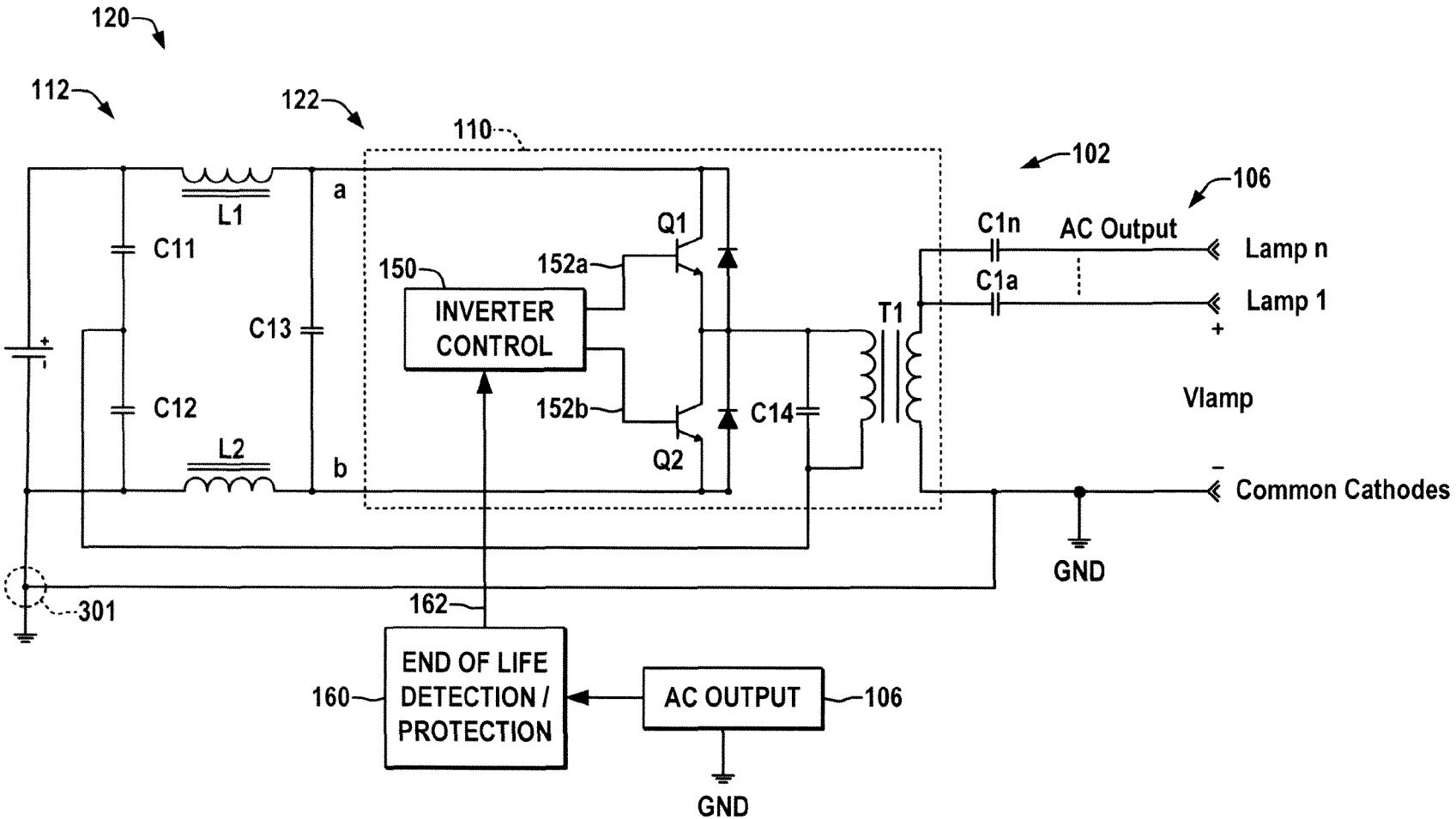
FIGS. 10-12 illustrate embodiments of an electronic ballast with a current-fed inverter and an EOL detection circuit, with an output circuit ground coupled with a stable node of the DC power source so that EOL detection and protection circuitry can control the inverter operation for EOL conditions without requiring isolated feedback components.
Figure 11:
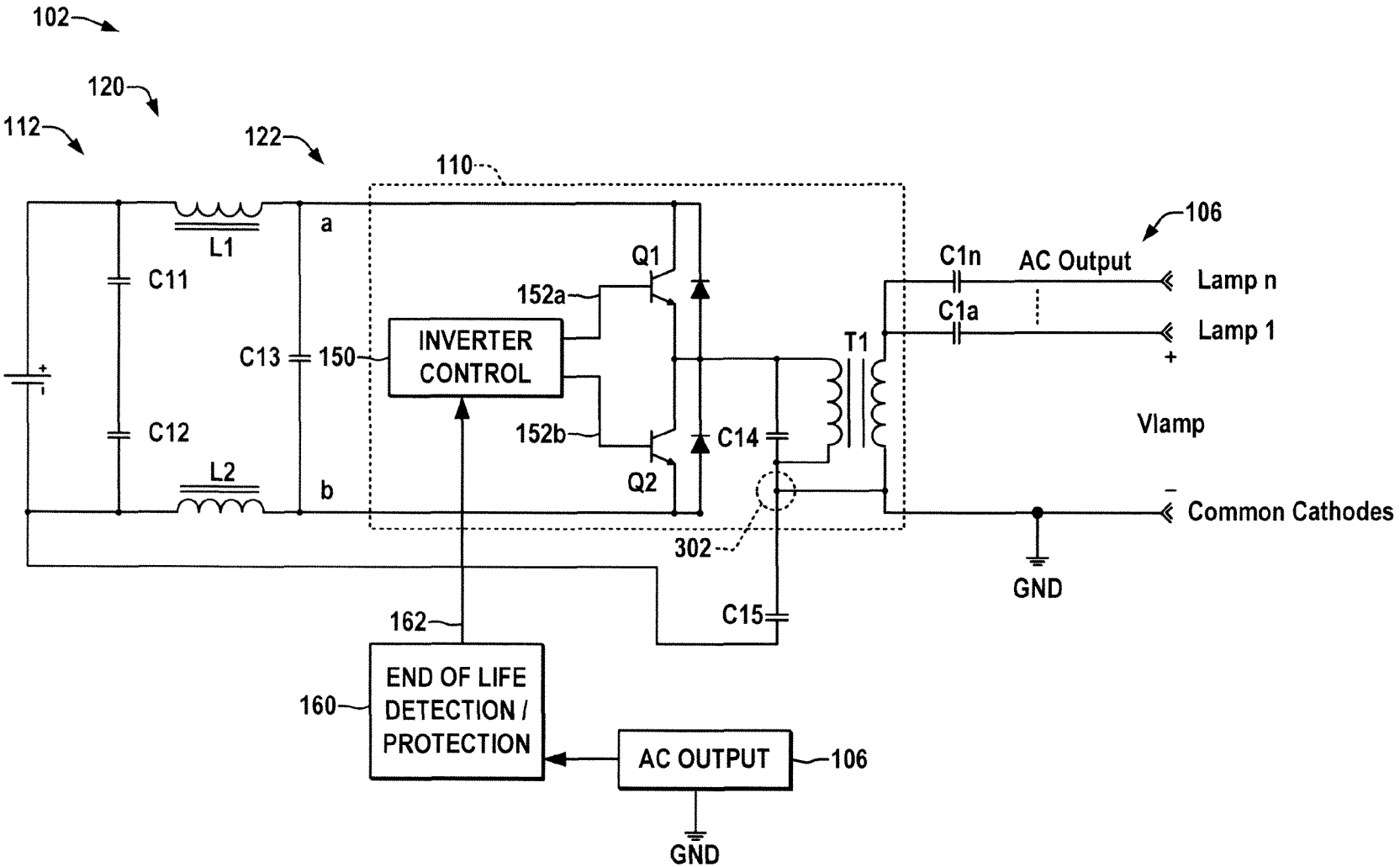
Figure 12:
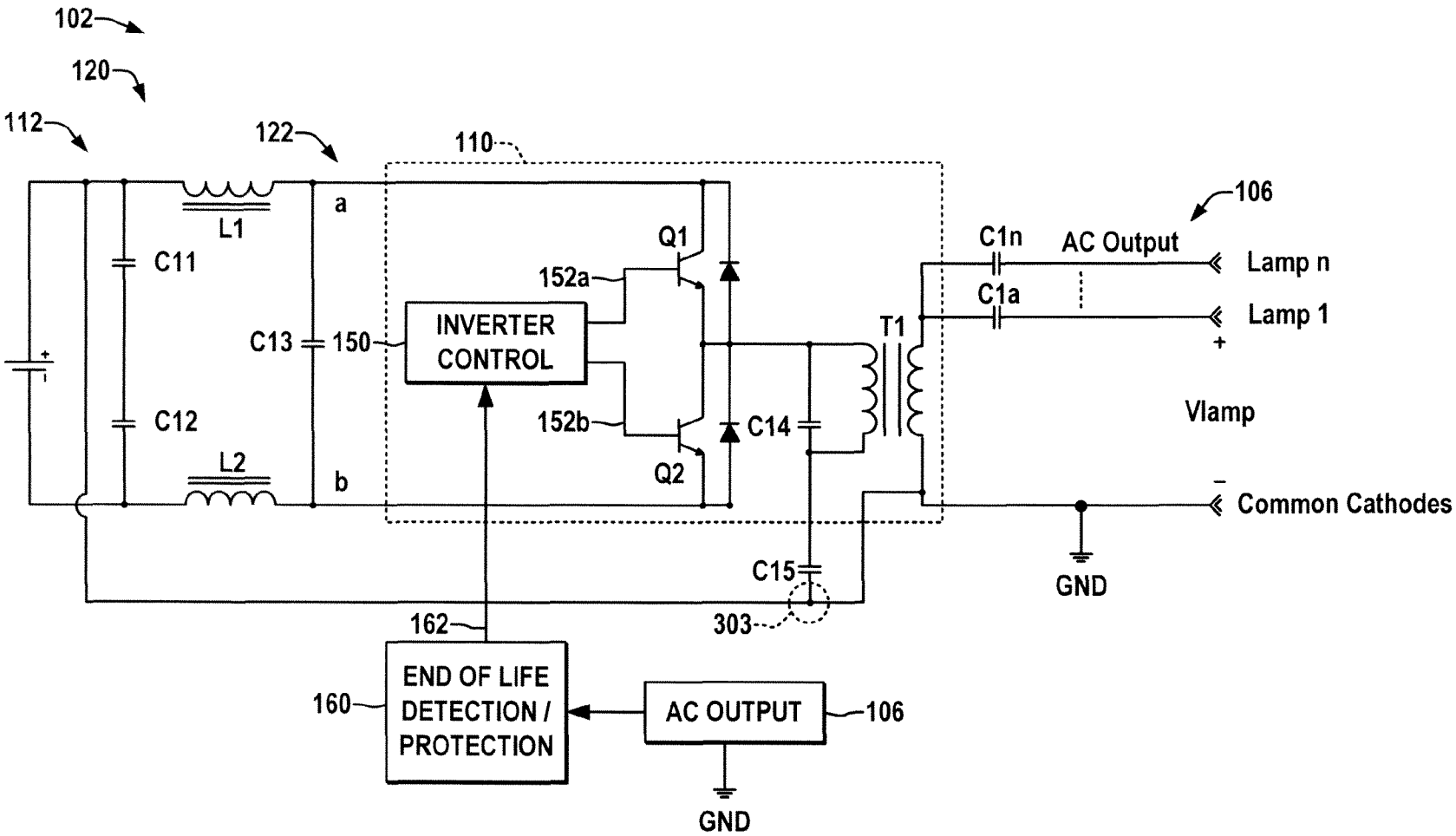

FIGS. 10-12 show an electronic ballast 102 with a current-fed inverter 140 where an output circuit ground coupled with a stable node of the DC power source 120 so that the EOL detection and protection circuit 160 can control the inverter operation for EOL conditions without requiring isolated feedback components. Because current-fed inverter architectures typically include a transformer T1 for isolation, conventional EOL detection was done using optical devices (not shown) to provide the sensed EOL signal to modify the inverter control. The embodiments of FIGS. 10-12 avoid the cost of optical isolation while facilitating EOL detection and protection in electronic ballasts 102 including current-fed topologies. In these embodiments, the DC power source 120 has an input 112 receiving input power and an output 122 providing DC electrical power to the inverter 140, where the converter 120 has positive and negative (e.g., upper and lower) circuit branches coupled between the input 112 and the output 122, where one or both of the positive and negative circuit branches includes a series inductance L1, L2 coupled between the input 112 and the output 122.

The inverter 140 in FIGS. 10-12 is an isolated inverter 140 operative to convert the DC electrical power to provide an AC output current to drive a plurality of the lamps 108, and includes one or more switching devices Q1, Q2 operative according to at least one inverter control signal (152*a*, 152*b*) to convert the input DC electrical power to AC power. The inverter 140 includes a transformer T1 with a primary circuit receiving the AC power from the switches Q1 and Q2, and a secondary circuit generating the AC output current. The inverter output 106 is coupled with the secondary circuit to provide the AC output current to the lamps 108 and includes an output circuit ground GND coupled with a stable node of the DC power source. The EOL circuit 160 senses the DC lamp voltages generates the EOL signal 164, the comparator output signal 166*a*, and the control input 162 as described above.

In the embodiment of FIG. 10, the output circuit ground GND is coupled with the negative circuit branch of the DC power source 120 via connection 301 between the input power 112 and the series inductances L1 and L2. In the embodiments of FIG. 11, the ballast 102 includes a capacitance C15 with an upper terminal coupled at node 302 with the output circuit ground GND at the lower ends of the transformer primary and secondary windings and the capacitance C15 has another (lower) terminal coupled with the negative circuit branch of the DC power source between the input power and the series inductances L1 and L2, by which the output GND is capacitively coupled to the negative DC circuit branch before the inductors L1 and L2. In the embodiment of FIG. 12, the lower terminal of capacitance C15 is coupled at node 303 with the output circuit ground GND and with the positive circuit branch of the DC power source 120 between the input power and the series inductances L1 and L2. The selective coupling of the output ground to a stable point allows sensing of the end of life indicia without requiring expensive optical coupling components and without introducing switching noise into the EOL sensing signal path.

Figure 13:
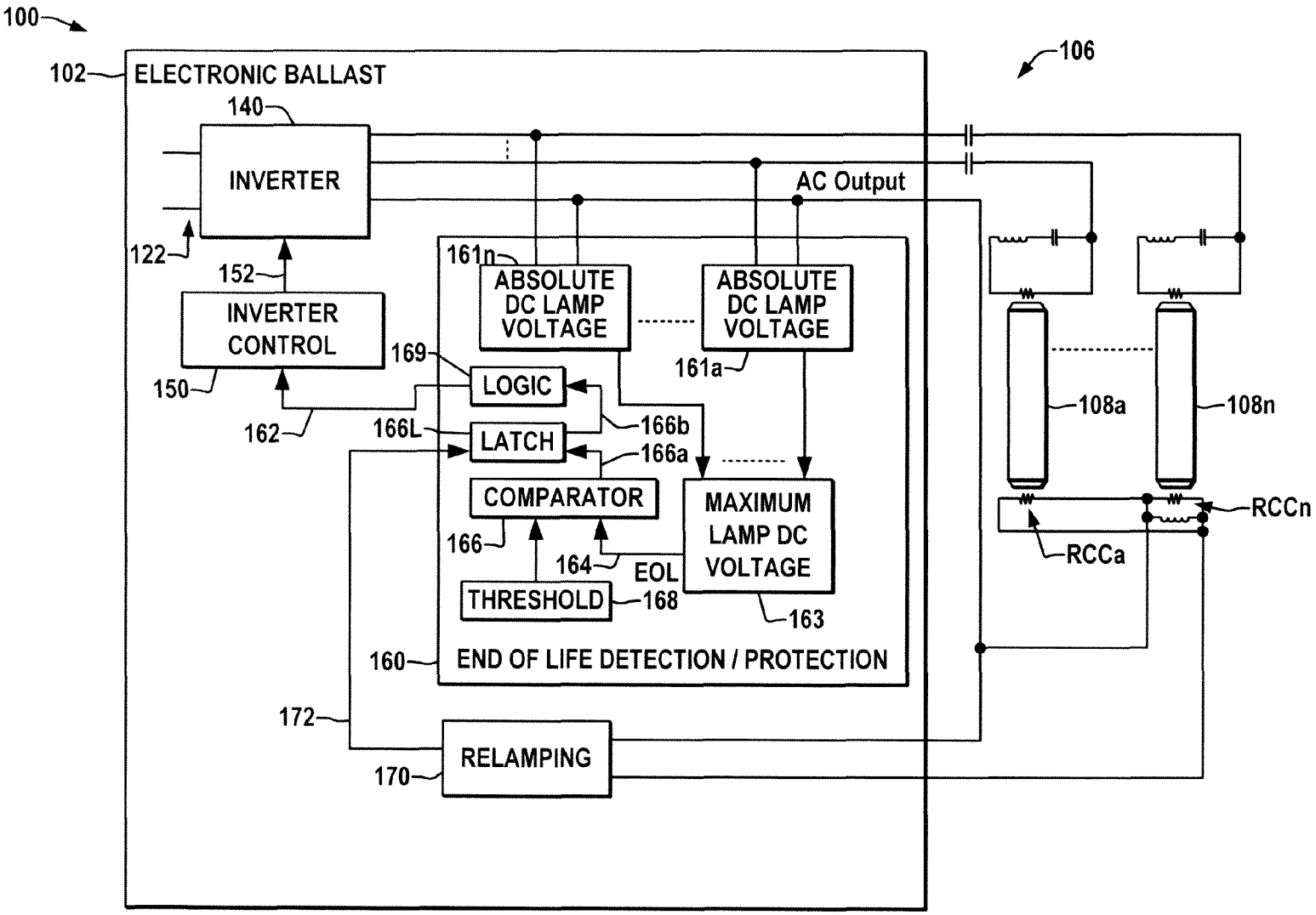
FIGS. 13 and 14 illustrate ballast embodiments in which an EOL condition signal is latched to control the inverter to dim the lamps until a relamping circuit senses that one or more of the lamps has been replaced.
Figure 14:
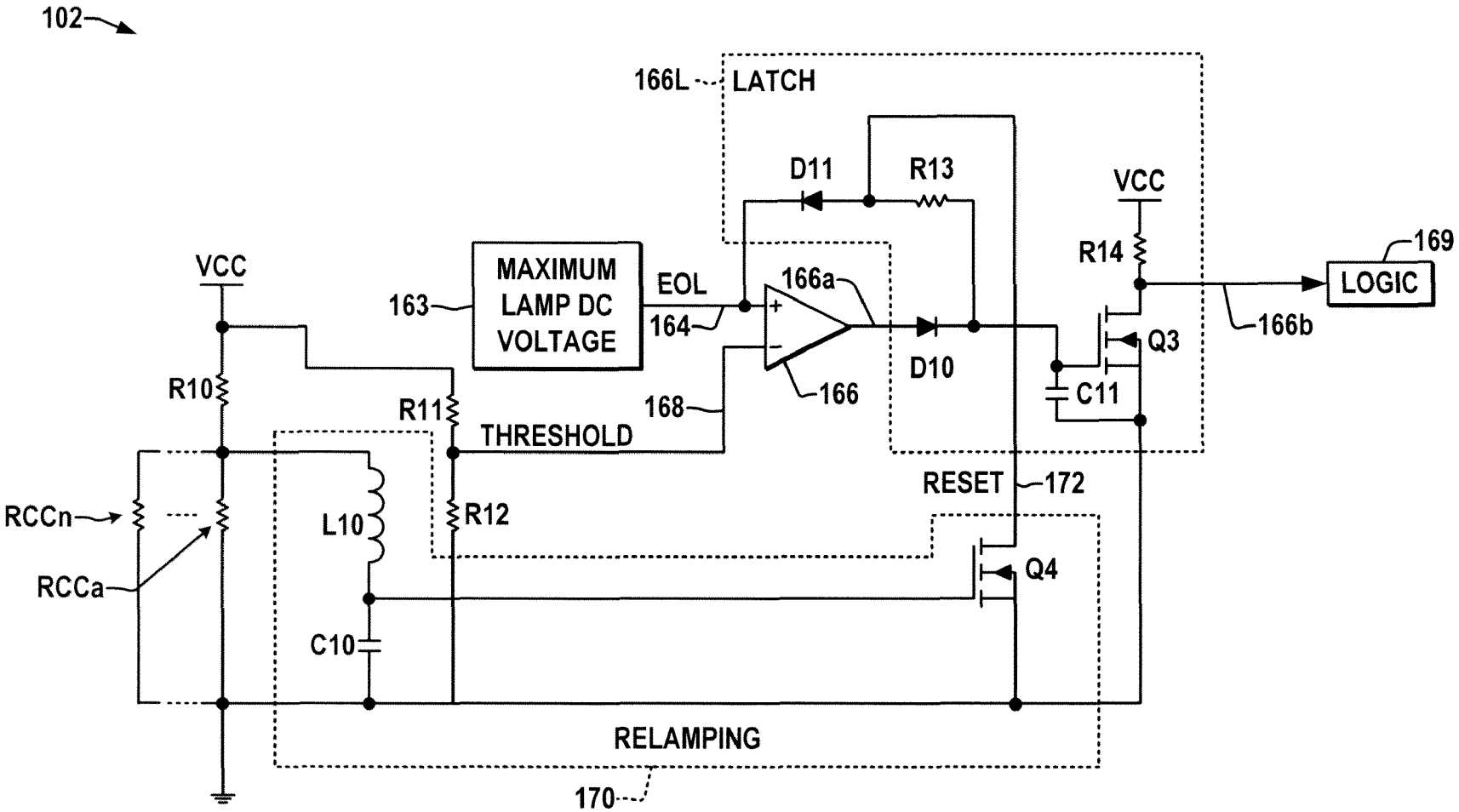

Referring to FIGS. 13 and 14, another ballast embodiment 102 is shown in which an EOL condition signal 166*a* is latched for dimming control via a latch circuit 166L until a relamping circuit 170 senses that one or more of the lamps 108 has been replaced to facilitate automatic restarting once a user relamps the ballast 102. The EOL circuit 160 senses DC lamp voltages and generates an EOL signal 164 by any suitable technique,. such as by the circuitry shown and described above in connection with FIGS. 3 and 4 in one example. The comparator 166 compares the EOL signal 164 with the threshold 168 and generates a comparator output signal 166*a* having a first state when the end-of-life signal 164 is less than the threshold 168 and a second state indicating at least one lamp has reached an end-of-life condition when the end-of-life signal 164 is greater than the threshold 168. The EOL circuit 160 in this embodiment includes a latch circuit 166L receiving and selectively latching the comparator output signal 166*a* to provide a latched comparator output signal 166*b* until a reset signal 172 is received. As described above, the logic circuit 169 receives the latched signal 166*b* and provides the inverter control input 162 so as to set a lamp current provided by the inverter 140 to implement selective dimming or otherwise implement an EOL protection scheme. The relamping circuit 170 senses the common cathode lamp resistances RCCa, RCCn in parallel and selectively resets the latch circuit 166L via signal 172 when a change in the sensed common cathode resistance indicates that one or more lamps 108 have been replaced. This operation facilitates the automatic restarting of the ballast 102 once the EOL lamp or lamps 108 have been replaced.

FIG. 14 shows one particular embodiment of a suitable relamping circuit 170 and latch circuit 166L that are operatively coupled with the comparator 166 and the source of an EOL signal 164. In this embodiment, the relamping circuit 170 provides an inductance L10 and a relamping capacitance C10 in series with one another and connected in parallel across the parallel common cathode resistances RCCa, RCCn of the lamps 108. The circuit 170 also includes a transistor Q4 with a control terminal (e.g. MOSFET gate) coupled to the center node of L10 and C10, and a signal terminal (drain) connected to the latch 166L to provide the reset signal 172 when a change in the sensed common cathode resistance RCC of the plurality of lamps 108 indicates at least one of the lamps 108 has been replaced. In steady state, the gate of Q4 is normally low, and if one or more of the common cathode resistances RCC is removed from the circuit (e.g., when a user removes one or more lamps 108), the gate turns Q4 on, thereby resetting the latch 166L, and the logic 169 resets the ballast 102 to restart automatically without further user action.

FIGS. 15-18 illustrate ballast EOL detection circuit embodiments 160 in which the EOL signal 164 is generated using a transformer-diac-based sensing circuit. The EOL circuit 160 in these embodiments includes a transformer T2 with a secondary circuit and one or more primary windings. The secondary side has a secondary side rectifier circuit, such as a full wave diode bridge D20, D21, D22, and D23 that provides a DC detection signal on positive and negative (e.g., upper and lower) rectifier output nodes based on current flowing in the secondary of T2. A rectifier capacitance C20 is coupled across the positive and negative rectifier output nodes and a logic circuit 169, such as a microcontroller (MCU) or timer circuit, receives the DC detection signal on the positive and negative rectifier output nodes. When the DC detection signal exceeds a threshold value, the logic circuit 169 provides the inverter control input 162 to shut down the inverter or set the lamp current to a dimming value or otherwise implements a desired EOL protection control scheme. A diac DB1 coupled in the circuit 160 in series with the primary winding of T2, and a capacitance Ct is coupled in parallel across the series combination of the diac DB1 and the primary winding.

Figure 15:
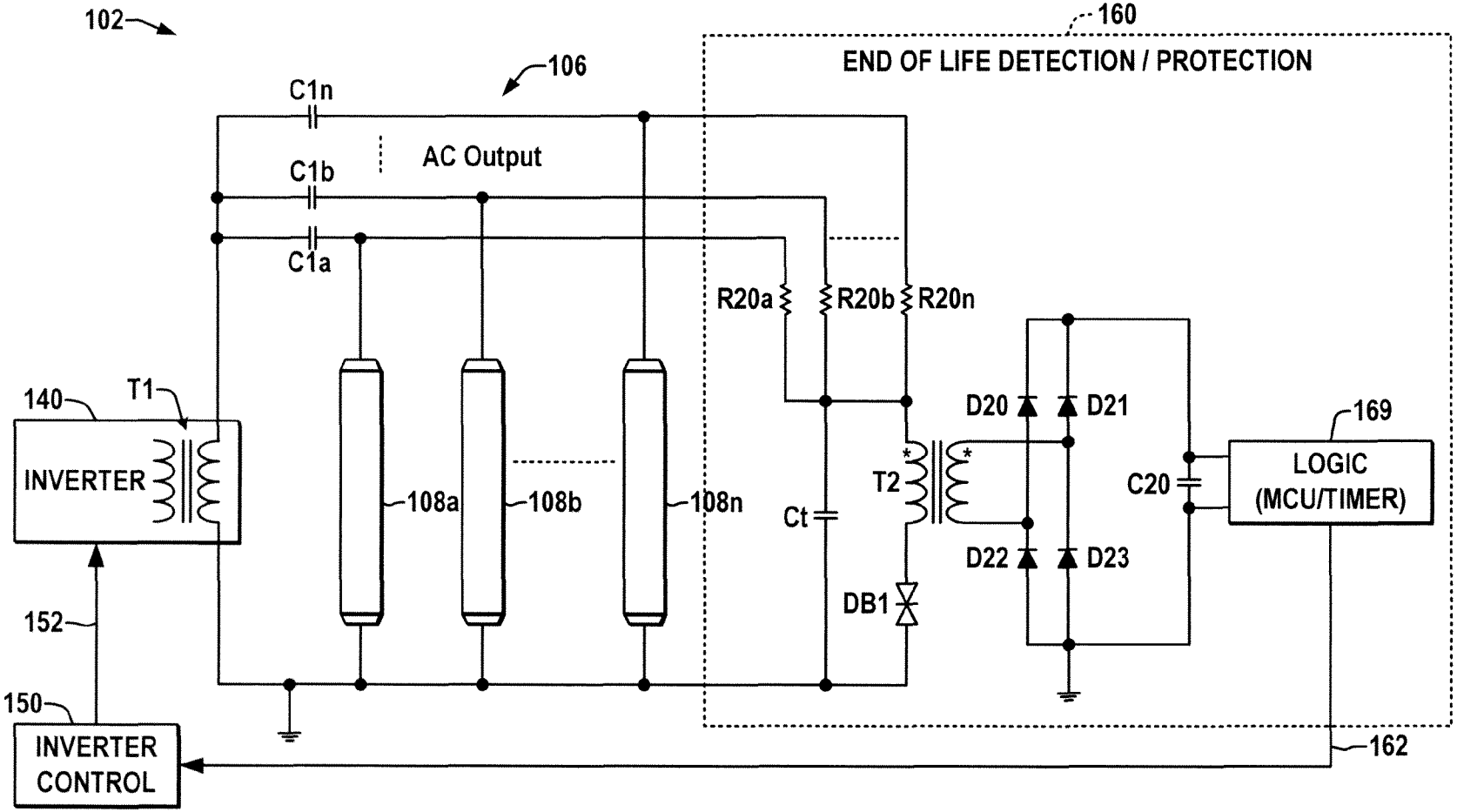
FIGS. 15-18 illustrate further electronic ballast embodiments with EOL detection circuitry including a transformer primary winding in series with a diac, and a capacitance coupled in parallel across the series combination of the diac and the transformer primary winding.
Figure 16:
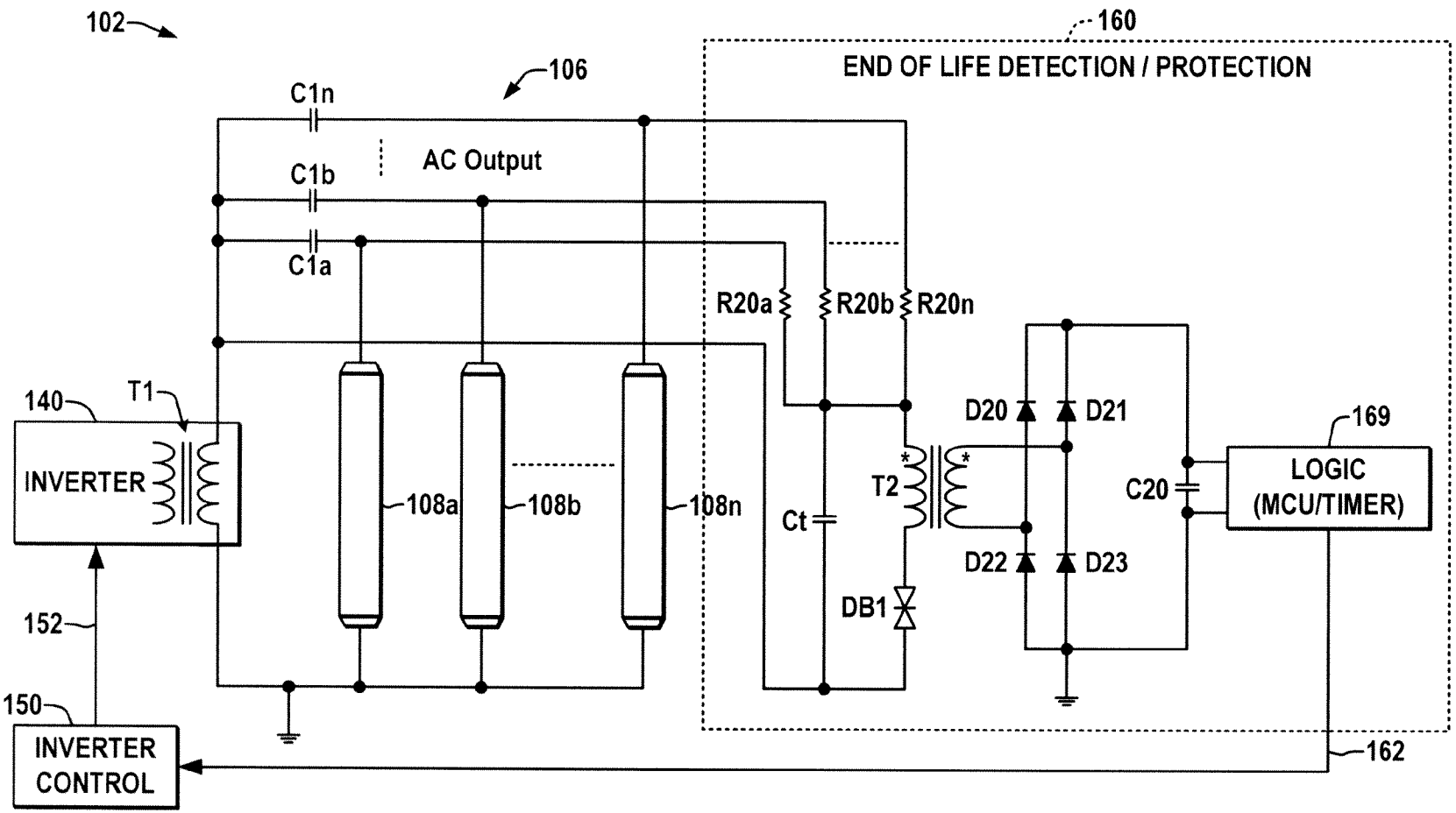
Figure 17:
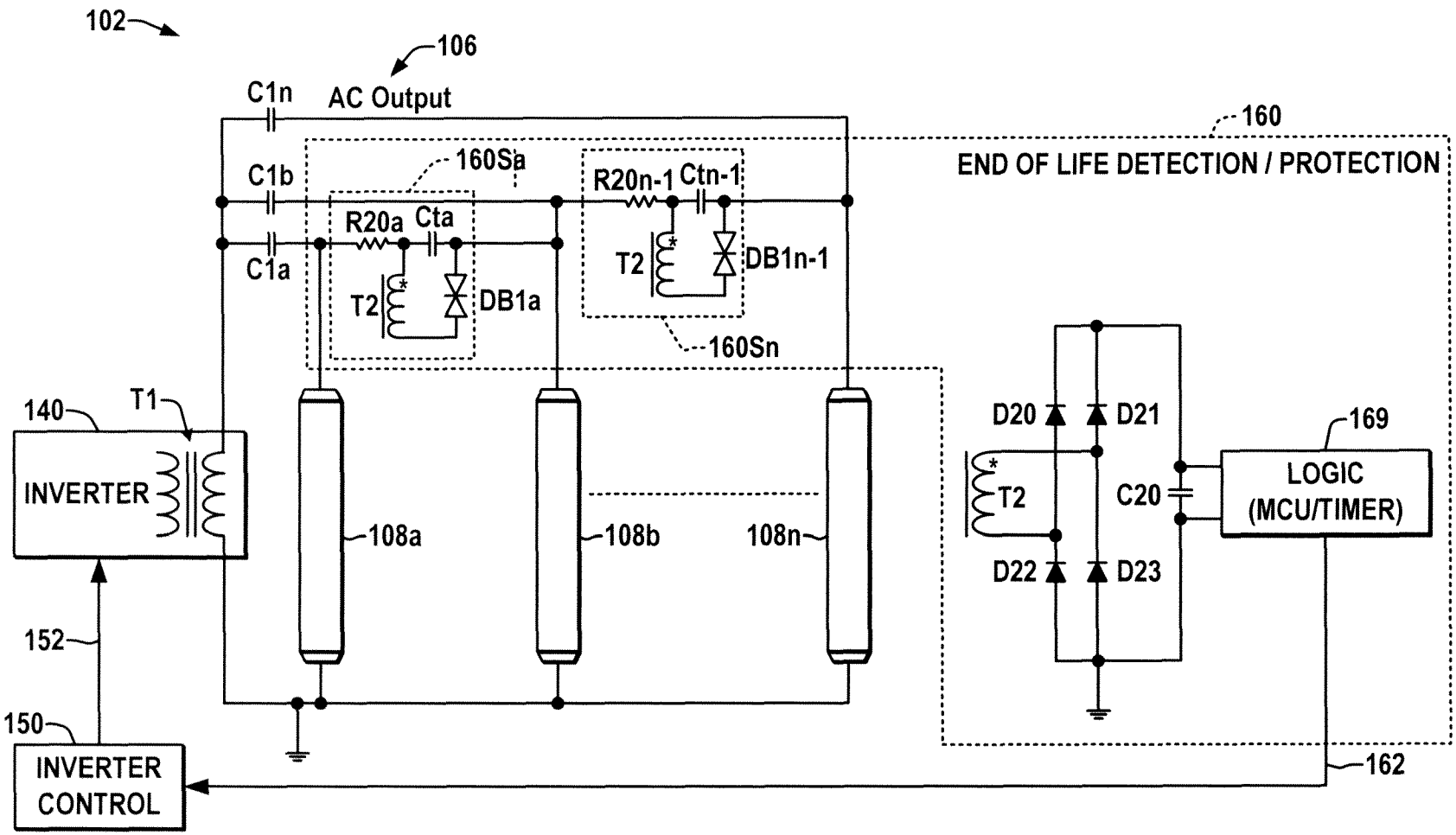
Figure 18:
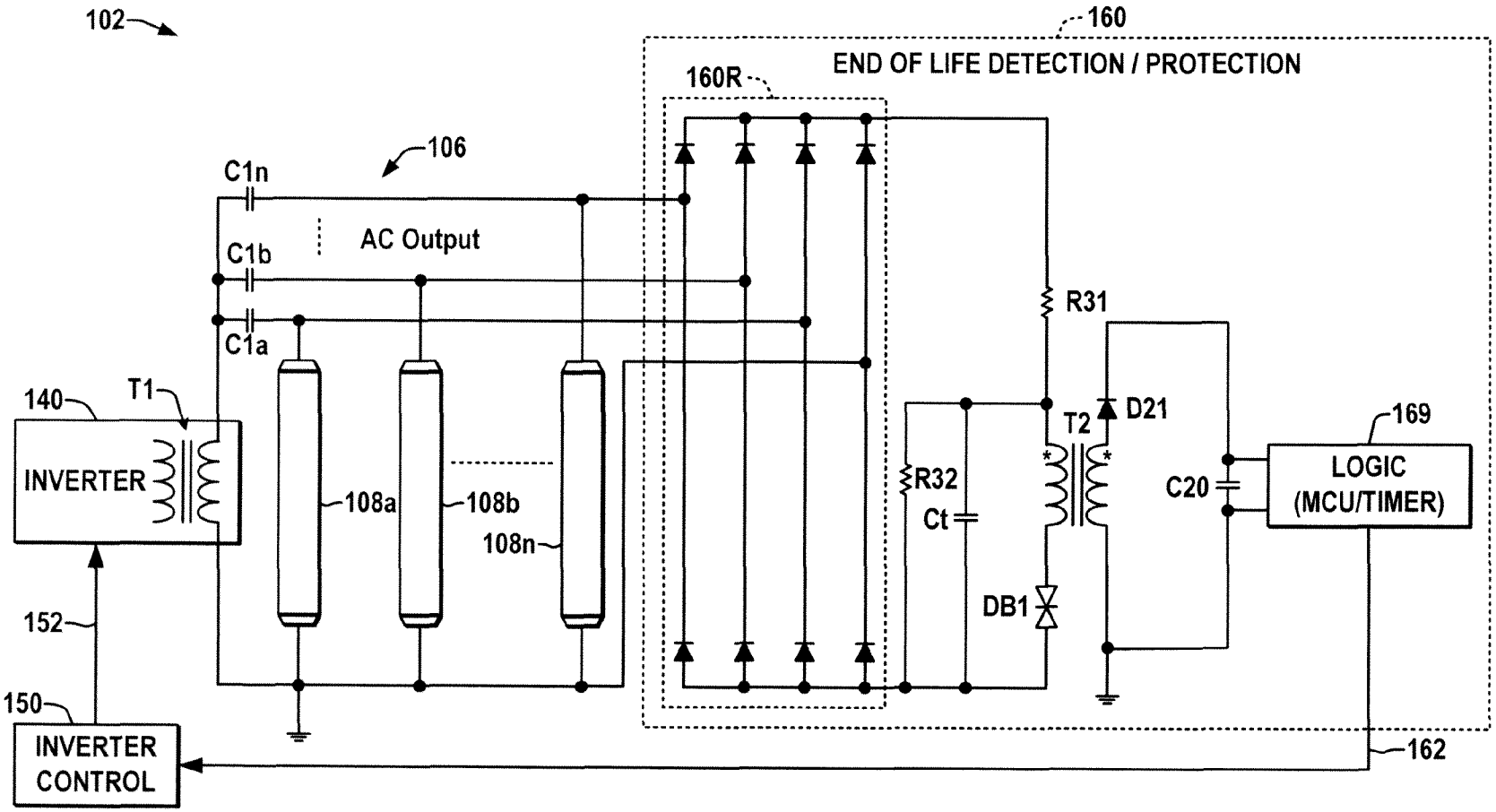

In the embodiments of FIGS. 15 and 16, a plurality of sense resistors R20 are connected with first resistor terminals coupled with the capacitance Ct and the primary winding of T2, and with second terminals coupled with corresponding lines of the inverter output 106. In the case of FIG. 15, the diac DB1 and the capacitance Ct are connected together at a node coupled with a common cathode terminal of the inverter output 106, and in the embodiment of FIG. 16, the diac DB1 and the capacitance Ct are connected together at a node coupled with a lamp output terminal of the inverter output 106. The EOL detection circuit 160 in the embodiment of FIG. 17 includes a plurality of sense circuits 160Sa, 160Sn that are individually coupled with a corresponding lamp 108, and the individual sense circuits 160S include a primary winding of T2, a diac DB1 coupled in series with the primary winding, a capacitance Cta, Ctn coupled in parallel across the series combination of the diac DB1 and the primary winding, and a sense resistor R20 coupled in series with the capacitance Ct between the corresponding lamp output terminal of the inverter output 106 and the corresponding lamp 108. In the case of FIG. 18, the EOL circuit 160 includes a diode-based primary side rectifier 160R coupled to rectify lamp voltages at the inverter output 106, which includes a positive circuit branch and a negative circuit branch, as well as a first rectifier sense resistor R31 coupled to the positive circuit branch of the primary side rectifier 160R, and a second rectifier sense resistor R32 coupled between the first rectifier sense resistor R31 and the negative circuit branch with a center node connecting R31 and R32 coupled to the capacitance Ct and to the primary winding of T2.

In conventional EOL sensing approaches, the capacitance of a shared sensing capacitor is always much larger than that of the output capacitances C1, whereby the EOL signal across the sense capacitor was typically small and difficult to detect. In the embodiments of FIGS. 15-18, when the lamps are running normally, the AC lamp current is symmetric and the voltage across the sense capacitance Ct is zero. If one or more lamps 108 reach the end-of-life, the lamp voltage becomes asymmetric and there will be a DC voltage across Ct. Once this DC voltage exceeds a threshold of the breakdown voltage of the diac DB3, the capacitance Ct will be discharged through the primary winding of the signal transformer T2. The transformer secondary circuit rectifies the resulting signal and used the rectified signal as an EOL indication for generating the inverter control input 162. The EOL detection circuits 160 of FIGS. 15-18 can be used in both current-fed and voltage-fed ballasts 102, and these circuits 160 are sensitive to both asymmetric pulse and asymmetric power tests defined by IEC61347-2-3. In addition, the circuits 160 integrate with an MCU or a designed timing logic 169 to facilitate elimination of unwanted noise coupling and false trigger and can implement auto-reset functionality.

The above examples are merely illustrative of several possible embodiments of various aspects of the present disclosure, wherein equivalent alterations and/or modifications will occur to others skilled in the art upon reading and understanding this specification and the annexed drawings. Moreover. the embodiments may be combined in any suitable fashion, such as the combination of any of the above described EOL detection circuits with any of the above described EOL protection functionality. In particular regard to the various functions performed by the above described components (assemblies, devices, systems, circuits, and the like), the terms (including a reference to a "means") used to describe such components are intended to correspond, unless otherwise indicated, to any component, such as hardware, software, or combinations thereof, which performs the specified function of the described component (i.e., that is functionally equivalent), even though not structurally equivalent to the disclosed structure which performs the function in the illustrated implementations of the disclosure. In addition, although a particular feature of the disclosure may have been illustrated and/or described with respect to only one of several implementations, such feature may be combined with one or more other features of the other implementations as may be desired and advantageous for any given or particular application. Furthermore, references to singular components or items are intended, unless otherwise specified, to encompass two or more such components or items. Also, to the extent that the terms "including", "includes", "having", "has", "with", or variants thereof are used in the detailed description and/or in the claims, such terms are intended to be inclusive in a manner similar to the term "comprising". The invention has been described with reference to the preferred embodiments. Obviously, modifications and alterations will occur to others upon reading and understanding the preceding detailed description. It is intended that the invention be construed as including all such modifications and alterations.

What is claimed is:

1. An electronic ballast for operating at least one lamp, comprising:

an inverter operative to convert a DC voltage to provide an AC output voltage at an inverter output to drive at least one lamp: and an end-of-life (EOL) detection circuit directly connected with the inverter output to sense an absolute DC lamp voltage of a lamp and operative to generate an end-of-life signal based on a maximum of the absolute DC lamp voltage, where the end-of-life detection circuit comprises:

a plurality of absolute DC lamp voltage sensing circuits operatively coupled with the inverter output to sense absolute DC lamp voltages of individual lamps, the individual absolute DC lamp voltage sensing circuits comprising:

a resistor coupled between a corresponding line of the inverter output and an intermediate node, and a capacitance coupled between the intermediate node and a sensing node;

a maximum lamp DC voltage circuit operatively coupled with the absolute DC lamp voltage sensing circuits to determine a maximum one of the absolute DC lamp voltages and to generate the end-of-life signal at a maximum lamp DC voltage output based on the maximum absolute DC lamp voltage, the maximum lamp DC voltage circuit comprising:

a plurality of first diodes coupled between corresponding intermediate nodes and the maximum lamp DC voltage output, a plurality of second diodes coupled between the corresponding intermediate nodes and a circuit ground, a positive sensing capacitance and a positive sense resistor coupled in parallel between the maximum lamp DC voltage output and the sense node, and a negative sensing capacitance and a negative sense resistor coupled in parallel between the sense node and the circuit ground; and a comparator operative to compare the end-of-life signal from the maximum lamp DC voltage output with a threshold and to generate a comparator output signal having a first state when the end-of-life signal is less than the threshold and a second state indicating at least one lamp has reached an end-of-life condition when the end-of-life signal is greater than the threshold;

where the inverter is operative to convert the DC voltage to provide the AC output voltage at the inverter output to drive a plurality of lamps: and where the EOL detection circuit is directly connected with the inverter output to sense absolute DC lamp voltages of individual lamps and operative to generate the end-of-life signal based on a maximum one of the absolute DC lamp voltages.

2. An electronic ballast for operating at least one lamp, comprising:

an inverter operative to convert a DC voltage to provide an AC output voltage at an inverter output to drive at least one lamp; and an end-of-life (EOL) detection circuit operatively coupled with the inverter output to sense a DC lamp voltage and operative to generate an end-of-life signal at a lamp DC voltage output coupled with a common cathode of the at least one lamp, the end-of-life detection circuit comprising:

a DC lamp voltage sensing circuit operatively coupled with the inverter output to sense the_DC lamp voltage, the DC lamp voltage sensing circuit comprising a resistor and a capacitance coupled in parallel between a line of the inverter output and the at least one lamp, a sense capacitance coupled between the lamp DC voltage output and a circuit ground, and a comparator operative to compare the end-of-life signal from the lamp DC voltage output with a threshold and to generate a comparator output signal having a first state when the end-of-life signal is less than the threshold and a second state indicating the at least one lamp has reached an end-of-life condition when the end-of-life signal is greater than the threshold.

3. An electronic ballast for operating at least one lamp, comprising:

an inverter operative to convert a DC voltage to provide an AC output voltage at an inverter output to drive at least one lamp at least partially according to an inverter control signal;

an inverter controller providing the inverter control signal to the inverter based at least in part on an inverter control input to control the AC output voltage at the inverter output; and an end-of-life (EOL) detection and protection circuit operatively coupled with the inverter output to sense a DC lamp voltage and operative to generate an end-of-life signal at a lamp DC voltage output coupled with a common cathode of the at least one lamp, the end-of-life detection and protection circuit comprising:

a comparator operative to compare the end-of-life signal from the lamp DC voltage output with a threshold and to generate a comparator output signal having a first state when the end-of-life signal is less than the threshold and a second state indicating at least one lamp has reached an end-of-life condition when the end-of-life signal is greater than the threshold, and a logic circuit receiving the comparator output signal and operative when the comparator output signal enters the second state to provide the inverter control input so as to set a lamp current provided by the inverter to a first dimming value less than a normal lamp current operating value for a first predetermined time period to cause one or more lamps in an end-of-life condition to go out, and to provide the inverter control input so as to set the lamp current provided by the inverter to a second dimming value greater than the first dimming value and less than the normal lamp current operating value for a second predetermined time period.

4. The electronic ballast of claim 3, where the inverter controller provides the inverter control signal to the inverter when the comparator output signal is in the second state so that a frequency of the inverter dimming lamp current is greater than 100 Hz.

5. An electronic ballast for operating at least one lamp, comprising:

an inverter operative to convert a DC voltage to provide an AC output voltage at an inverter output to drive at least one lamp at least partially according to an inverter control signal;

an inverter controller providing the inverter control signal to the inverter based at least in part on an inverter control input to control the AC output voltage at the inverter output;

a preheat circuit operatively coupled with a common cathode connection of the inverter output to selectively provide current to preheat at least one lamp cathode according to a preheat control signal; and an end-of-life (EOL) detection and protection circuit operatively coupled with the inverter output to sense a DC lamp voltage and operative to generate an end-of-life signal at a lamp DC voltage output coupled with the at least one lamp cathode, the end-of-life detection and protection circuit comprising:

a comparator operative to compare the end-of-life signal from the lamp DC voltage output with a threshold and to generate a comparator output signal having a first state when the end-of-life signal is less than the threshold and a second state indicating at least one lamp has reached an end-of-life condition when the end-of-life signal is greater than the threshold, and a logic circuit receiving the comparator output signal and operative to provide the inverter control input so as to set a lamp current provided by the inverter to a dimming value less than a normal lamp current operating value and to provide the preheat control signal to cause the preheat circuit to provide current to preheat the at least one lamp cathode when the comparator output signal enters the second state.

6. An electronic ballast for operating at least one lamp, comprising:

a DC power source with an input receiving input power, an output providing DC electrical power, and positive and negative circuit branches coupled between the input and the output, at least one of the positive and negative circuit branches including a series inductance coupled between the input and the output;

a current-fed inverter operative to convert the DC electrical power to provide an AC output current to drive a plurality of lamps, the inverter including:

at least one switching device operative according to at least one inverter control signal to convert the input DC electrical power to AC power, a transformer circuit including a primary circuit receiving AC power from the at least one switching device, and a secondary circuit generating the AC output current, and an inverter output coupled with the secondary circuit to provide the AC output current to drive a plurality of lamps, the inverter output including an output circuit ground directly connected with a stable node of the DC power source; and an end-of-life (EOL) detection and protection circuit operatively directly connected with the inverter output to sense DC lamp voltages and operative to generate an end-of-life signal, and including a comparator operative to compare the end-of-life signal from the lamp DC voltage output with a threshold and to generate a comparator output signal having a first state when the end-of-life signal is less than the threshold and a second state indicating at least one lamp has reached an end-of-life condition when the end-of-life signal is greater than the threshold.

7. The electronic ballast of claim 6, where the output circuit ground is coupled with the negative circuit branch of the DC power source between the input power and the series inductance.

8. The electronic ballast of claim 6, further comprising a capacitance having a first terminal coupled with the output circuit ground and a second terminal coupled with the negative circuit branch of the DC power source between the input power and the series inductance.

9. The electronic ballast of claim 6, further comprising a capacitance having a first terminal coupled with the transformer primary circuit and a second terminal coupled with the output circuit ground and with the positive circuit branch of the DC power source between the input power and the series inductance.

10. An electronic ballast for operating at least one lamp, comprising:

an inverter operative to convert a DC voltage to provide an AC output voltage at an inverter output to drive at least one lamp at least partially according to an inverter control signal;

an inverter controller providing the inverter control signal to the inverter based at least in part on an inverter control input to control the AC output voltage at the inverter output;

an end-of-life (EOL) detection and protection circuit operatively coupled with the inverter output to sense a DC lamp voltage and operative to generate an end-of-life signal, the end-of-life detection and protection circuit comprising:

a comparator operative to compare the end-of-life signal with a threshold and to generate a comparator output signal having a first state when the end-of-life signal is less than the threshold and a second state indicating the at least one lamp has reached an end-of-life condition when the end-of-life signal is greater than the threshold, a latch circuit operatively coupled with the comparator to receive the comparator output signal and to provide a latched comparator output signal until a reset signal is received, and a logic circuit receiving the latched comparator output signal and operative to provide the inverter control input so as to set a lamp current provided by the inverter; and a relamping circuit operatively coupled with a common cathode connection of the inverter output to sense a common cathode resistance of the at least one lamp and to selectively provide the reset signal to the latch circuit when a change in the sensed common cathode resistance of the at least one lamp indicates that the at least one lamp has been replaced.

11. An electronic ballast for operating at least one lamp, comprising:

an inverter operative to convert a DC voltage to provide an AC output voltage at an inverter output to drive at least one lamp according to an inverter control signal;

an inverter controller providing the inverter control signal to the inverter based at least in part on an inverter control input to control the AC output voltage at the inverter output;

an end-of-life (EOL) detection circuit operatively coupled with the inverter output to sense a DC lamp voltage and operative to generate the inverter control input, the end-of-life detection circuit comprising:

a transformer with a secondary circuit and at least one primary winding, a secondary side rectifier circuit operatively coupled with the secondary circuit to provide a DC detection signal on positive and negative rectifier output nodes based on current flowing in the secondary circuit, a rectifier capacitance coupled across the positive and negative rectifier output nodes, a logic circuit receiving the DC detection signal on the positive and negative rectifier output nodes and operative when the DC detection signal exceeds a threshold value to provide the inverter control input so as to shut down the inverter or set a lamp current provided by the inverter to a dimming value less than a normal lamp current operating value, a diac coupled in series with the at least one primary winding of the transformer, and a capacitance coupled in parallel across the series combination of the diac and the primary winding of the transformer.

12. The electronic ballast of claim 2:

where the inverter is operative to convert the DC voltage to provide the AC output voltage at the inverter output to drive a plurality of lamps; and where the end-of-life (EOL) detection circuit is operatively coupled with the inverter output to sense DC lamp voltages and operative to generate the end-of-life signal at the lamp DC voltage output coupled with common cathodes of the lamps, the end-of-life detection circuit comprising:

a plurality of DC lamp voltage sensing circuits operatively coupled with the inverter output to sense DC lamp voltages of individual lamps, the individual DC lamp voltage sensing circuits comprising a resistor and a capacitance coupled in parallel between a corresponding line of the inverter output and a corresponding lamp, a sense capacitance coupled between the lamp DC voltage output and a circuit ground, and a comparator operative to compare the end-of-life signal from the lamp DC voltage output with a threshold and to generate a comparator output signal having a first state when the end-of-life signal is less than the threshold and a second state indicating at least one lamp has reached an end-of-life condition when the end-of-life signal is greater than the threshold.

13. The electronic ballast of claim 3, where the inverter is operative to convert the DC voltage to provide the AC output voltage at the inverter output to drive a plurality of lamps at least partially according to the inverter control signal; and where the EOL detection and protection circuit is operatively coupled with the inverter output to sense DC lamp voltages and operative to generate the end-of-life signal at the lamp DC voltage output coupled with common cathodes of the plurality of lamps, the logic circuit receiving the comparator output signal and operative when the comparator output signal enters the second state to provide the inverter control input so as to set a lamp current provided by the inverter to a first dimming value less than a normal lamp current operating value for a first predetermined time period to cause one or more lamps in an end-of-life condition to go out, and to provide the inverter control input so as to set the lamp current provided by the inverter to a second dimming value greater than the first dimming value and less than the normal lamp current operating value for a second predetermined time period to avoid excessively low lamp current to lamps that are not in an end-of-life condition without igniting the one or more lamps in an end-of-life condition.

14. The electronic ballast of claim 13, where the logic circuit is further operative if the comparator output signal returns to the first state after the second predetermined time period to provide the inverter control input so as to set the lamp current provided by the inverter to the normal lamp current operating value, or if the comparator output signal remains in the second state after the second predetermined time period, to provide the inverter control input so as to again set the lamp current provided to the first dimming value for another first predetermined time period and then to set the lamp current to the second dimming value for another second predetermined time period.

15. The electronic ballast of claim 5, where the inverter is operative to convert the DC voltage to provide the AC output voltage at the inverter output to drive a plurality of lamps at least partially according to the inverter control signal, where the preheat circuit is operative to selectively provide current to preheat the lamp cathodes according to the preheat control signal, where the EOL detection and protection circuit is operatively coupled with the inverter output to sense DC lamp voltages and operative to generate the end-of-life signal at the lamp DC voltage output coupled with common cathodes of the lamps, and where the logic circuit is operative to provide the preheat control signal to cause the preheat circuit to provide current to preheat the lamp cathodes when the comparator output signal enters the second state.

16. The electronic ballast of claim 10, where the inverter is operative to convert the DC voltage to provide the AC output voltage at the inverter output to drive a plurality of lamps at least partially according to the inverter control signal, where the EOL detection and protection circuit is operatively coupled with the inverter output to sense DC lamp voltages, and where the relamping circuit is operatively coupled with the common cathode connection of the inverter output to sense a common cathode resistance of the plurality of lamps and to selectively provide the reset signal to the latch circuit when a change in the sensed common cathode resistance of the plurality of lamps indicates that at least one of the lamps has been replaced.

17. The electronic ballast of claim 16, where the relamping circuit comprises a series combination of an inductance and a relamping capacitance connected in parallel across the common cathode resistance of the plurality of lamps, and a transistor with a control terminal coupled to a center node of the inductance and the relamping capacitance, the transistor having a signal terminal operatively coupled to provide the reset signal to the latch circuit when a change in the sensed common cathode resistance of the plurality of lamps indicates at least one of the lamps has been replaced.

18. The electronic ballast of claim 11, where the inverter is operative to convert the DC voltage to provide the AC output voltage at the inverter output to drive a plurality of lamps according to the inverter control signal, and where the EOL detection circuit is operatively coupled with the inverter output to sense DC lamp voltages.

19. The electronic ballast of claim 18, comprising a plurality of sense resistors having first terminals coupled with the capacitance and the primary winding of the transformer, and second terminals coupled with corresponding lines of the inverter output.

20. The electronic ballast of claim 19, where the diac and the capacitance are connected together at a node coupled with a common cathode terminal of the inverter output.

21. The electronic ballast of claim 19, where the diac and the capacitance are connected together at a node coupled with a lamp output terminal of the inverter output.

22. The electronic ballast of claim 18, the end-of-life detection circuit comprising a plurality of sense circuits individually coupled with a corresponding one of the plurality of lamps, the individual sense circuits comprising:

a primary winding of the transformer, a diac coupled in series with the primary winding, a capacitance coupled in parallel across the series combination of the diac and the primary winding, and a sense resistor coupled in series with the capacitance between the corresponding lamp output terminal of the inverter output and the corresponding lamp.

23. The electronic ballast of claim 18, the end-of-life detection circuit comprising:

a primary side rectifier coupled with the inverter output and operative to rectify lamp voltages of the plurality of lamps, the primary side rectifier having a positive circuit branch and a negative circuit branch;

a first rectifier sense resistor coupled to the positive circuit branch of the primary side rectifier; and a second rectifier sense resistor coupled between the first rectifier sense resistor and the negative circuit branch of the primary side rectifier, with a center node connecting the first and second rectifier sense resistors is coupled to the capacitance and to the primary winding of the transformer.

* * * * *